US011060271B2

(12) United States Patent
Bailey

(10) Patent No.: US 11,060,271 B2
(45) **Date of Patent: *Jul. 13, 2021**

(54) PORTABLE PERSONAL HYGIENE DEVICE

(71) Applicant: Joe H. Bailey, Florence, SC (US)

(72) Inventor: Joe H. Bailey, Florence, SC (US)

( * ) Notice: Subject to any disclaimer, the term of this patent is extended or adjusted under 35 U.S.C. 154(b) by 32 days.

This patent is subject to a terminal disclaimer.

(21) Appl. No.: 16/450,134

(22) Filed: Jun. 24, 2019

(65) Prior Publication Data

US 2020/0399882 A1 Dec. 24, 2020

(51) Int. Cl.
*E03D 9/08* (2006.01)
*E03D 11/02* (2006.01)
*A47K 13/30* (2006.01)

(52) U.S. Cl.
CPC ..... *E03D 9/08* (2013.01); *A47K 13/302* (2013.01); *E03D 11/025* (2013.01)

(58) Field of Classification Search
CPC ..... E03D 9/08; E03D 11/025; A47K 13/302
USPC ..... 4/443
See application file for complete search history.

(56) References Cited

U.S. PATENT DOCUMENTS 3,430,268 A * 3/1969 Zoberg ..... E03D 9/08 4/420.1
3,602,921 A 9/1971 Umann
3,808,608 A 5/1974 Caplan
3,914,804 A 10/1975 Schrader et al.
4,259,754 A 4/1981 Bader et al.
4,622,704 A * 11/1986 Chung ..... E03D 9/085 126/344
5,359,736 A * 11/1994 Olivier ..... E03D 9/08 4/420.2
5,570,479 A * 11/1996 Chomik ..... A47K 13/12 4/420.2
5,911,516 A 6/1999 Chang
6,167,577 B1 1/2001 Hammad
6,192,527 B1 2/2001 Paul
7,216,374 B2 5/2007 Hassan
10,563,390 B2 * 2/2020 Schwab ..... B05B 15/62
2006/0150311 A1 * 7/2006 Chang Chien ..... E03D 9/085 4/420.4

* cited by examiner

*Primary Examiner* — Huyen D Le
(74) *Attorney, Agent, or Firm* — P. Jeff Martin; The Law Firm of P. Jeffrey Martin, LLC

(57) ABSTRACT

A portable personal hygiene device is detachably secured to a toilet bowl rim via an integral mounting bracket. The hygiene device controllably directs liquid, water, or other solution to the posterior portions of a user's body through a nozzle assembly. The hygiene device includes a housing which encloses a power source, a motor and a pump. An adjustable brace is included to facilitate enhanced secured attachment of the hygiene device to the toilet rim. A replaceable, reusable reservoir provides the water supply for the pump. The nozzle assembly is movable between retracted and extended positions.

17 Claims, 19 Drawing Sheets

PORTABLE PERSONAL HYGIENE DEVICE

RELATED APPLICATIONS

This application is related to U.S. application Ser. No. 14/287,032, filed on May 25, 2014, now U.S. Pat. No. 9,464,425 B2.

BACKGROUND OF THE INVENTION

1. Field of the Invention

The present invention relates generally to conventional toilet fixture attachments, and more particularly, to an improved portable personal hygiene device.

2. Description of the Related Art

Currently there exist in the art various bidets, bidet systems, and methods for cleansing the underside region of a user. However, the prior art has failed to disclose or teach a portable personal hygiene device which includes an integrally formed bracket for detachably securing the device to a toilet rim, a fully retractable and extendable nozzle assembly, a discharge control and adjustment mechanism, a retractable and extendable brace, or a portable remote control device for remotely controlling the operation of the hygiene device.

Accordingly, a need exists for an improved personal hygiene device for cleansing and treating the posterior regions of a user. The development of the portable personal hygiene device fulfills this need.

A search of the prior art did not disclose any patents that read directly on the claims of the instant invention; however, the following references were considered related:

U.S. Pat. No. 6,167,577 B1, issued in the name of Hammad;

U.S. Pat. No. 6,192,527 B1, issued in the name of Paul;

U.S. Pat. No. 7,216,374 B2, issued in the name of Hassan;

U.S. Pat. No. 3,602,921, issued in the name of Umann;

U.S. Pat. No. 3,808,608, issued in the name of Caplan;

U.S. Pat. No. 3,914,804 issued in the name of Schrader et al.;

U.S. Pat. No. 4,259,754, issued in the name of Bader et al.; and

U.S. Pat. No. 5,911,516, issued in the name of Chang.

Consequently, a need has been felt for an improved portable personal hygiene device for treating and/or cleansing and anal region of a user in a manner which is quick, easy, and efficient.

This application presents claims and embodiments that fulfill a need or needs not yet satisfied by the products, inventions and methods previously or presently available. In particular, the claims and embodiments disclosed herein describe a portable hygiene device being detachably secured to the rim edge of a toilet bowl, the device comprising a housing, the housing comprises an integrally molded first interior chamber; an integrally molded second interior chamber; a power source, the power source is enclosed within the first interior chamber; a motor; a control switch; a pump, the pump and motor are enclosed within the second interior chamber, the pump is driven by the motor, the motor is powered via the power source, activation of the motor is controlled by the control switch; a nozzle assembly; a flexible discharge conduit interconnecting the nozzle assembly with the pump; a flexible intake conduit interconnecting the pump and a reservoir, the pump draws liquid from the reservoir via the flexible intake conduit, and wherein the pump transfers the drawn liquid into the flexible discharge conduit through which liquid is delivered to the nozzle assembly and discharged therefrom as a spray or stream, the nozzle assembly and the flexible discharge conduit are slidably movable between fully retracted and extended positions via a discharge control and adjustment mechanism; a container adapter for removably attaching the reservoir to the housing; a means for enabling the nozzle assembly to oscillate and discharge liquid in a concurrent fashion; and a portable remote control device for remotely controlling the operation of the hygiene device, the portable hygiene device providing unanticipated and nonobvious combination of features distinguished from the products, inventions and methods preexisting in the art. The applicant is unaware of any device, method, disclosure or reference that discloses the features of the claims and embodiments disclosed herein.

SUMMARY OF THE INVENTION

Briefly described according to one embodiment of the present invention, a portable personal hygiene device is disclosed. The hygiene device is adapted and configured to be detachably secured to a container, such as a bucket, and more particularly, a toilet bowl of a conventional toilet fixture. The hygiene device controllably directs liquid, water, or other solution to the posterior portions of a user's body. The hygiene device comprises a housing comprising a two-piece unit which includes abutting half sections. The abutting half sections being mutually cooperative for secured connection to one another forming an interior chamber for enclosing a power source, and an interior chamber for enclosing a motor and a pump.

The housing further comprises a mounting bracket for fitting over and frictionally engaging the toilet rim of the toilet bowl, thereby detachably securing the hygiene device to the toilet bowl.

In accordance to one embodiment, the mounting bracket is telescopically adjustable so as to allow for a plurality of selectively-desired, latitudinal setting positions thereof.

An adjustable brace is provided to facilitate enhanced secured attachment of the hygiene device to the toilet rim.

The pump is driven by the electric motor which is powered via the power source, such as rechargeable batteries. Activation of the motor is controlled by a control switch.

A flexible, retractable discharge conduit interconnects a nozzle assembly with the pump. The pump transfers water from a reservoir to the discharge outlet of the nozzle assembly. The reservoir may include a beverage container, such as a plastic bottle. A flexible conduit interconnects the pump and the reservoir, wherein the pump draws water from the reservoir via the flexible conduit and transfers the water into the flexible, retractable discharge conduit through which water is delivered to the nozzle assembly and discharged therefrom as a spray or stream. The nozzle assembly and discharge conduit are slidably movable between fully retracted and extended positions.

A discharge control and adjustment mechanism is provided for both controlling the extension and retraction of the nozzle assembly and discharge conduit, and engaging the control switch, thereby activating the motor.

A reservoir coupling mechanism is provided for detachably securing a reservoir to the housing.

A means for enabling the nozzle assembly to oscillate and discharge liquid in a concurrent fashion is disclosed.

In accordance to one embodiment, a portable remote control device is disclosed for remotely controlling the operation of the hygiene device.

In accordance to another embodiment, a portable personal hygiene device is disclosed which includes a means by which the pump thereof may be detachably connected and in fluid communication with a conventional water line.

BRIEF DESCRIPTION OF THE DRAWINGS

The advantages and features of the present invention will become better understood with reference to the following more detailed description and claims taken in conjunction with the accompanying drawings, in which like elements are identified with like symbols, and in which:

DESCRIPTION OF THE PREFERRED EMBODIMENT

Detailed Description of the Figures

Referring now to FIGS. 1-5, 7, and 9, a portable personal hygiene device, generally designated at 10 is disclosed, according to one embodiment of the present invention, the personal hygiene device 10, hereinafter "hygiene device 10", is adapted and configured to be detachably secured to a container 1, such as a bucket, and more particularly, a toilet bowl 5 of a conventional toilet fixture 2.

Figure 8:
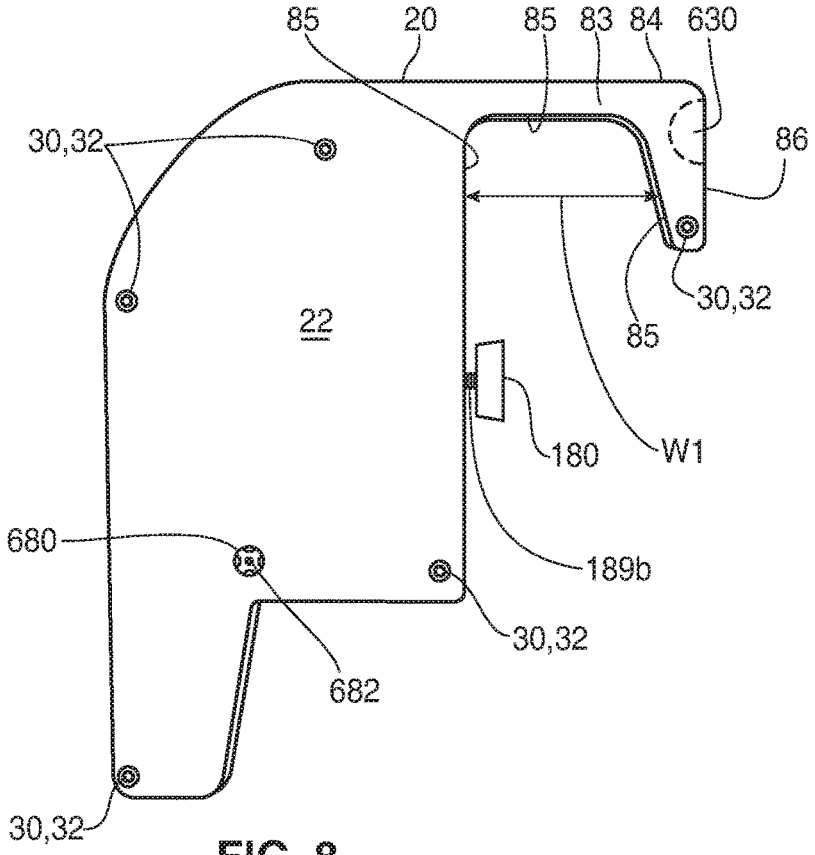
FIG. 8 is a right side elevational view of the personal hygiene device, in accordance to one embodiment of the present invention.

The hygiene device 10 controllably directs water 7, hygienic solutions, solutions comprising medicinal agents, or other selectively-desired liquids or solutions capable of being dispensed or discharged as a spray or stream, to a selected localized area, such as the posterior portions (anal region) and genitals of a user's body. The hygiene device 10 comprises a housing 20 which includes at least one integrally molded chamber. In accordance with one embodiment, the at least one integrally molded chamber comprises an integrally molded first interior chamber 12 enclosing a power source 70, and an integrally molded second interior chamber 14 enclosing a motor 74 and pump 50. The housing 20 may include one or more airflow openings 680 disposed therein, as shown in FIG. 8.

The housing 20 further comprises a two-piece unit 20*a*, the unit 20*a* comprising abutting half sections 22 and 26, wherein each section 22, 26 respectively defines a plate 1023, 1027 or body having a continuous sidewall 24, 28 extending upward integrally therefrom, and a dorsal side D and ventral side V. The half sections 22 and 26 each further includes an upper portion 22*a*, 26*a*, a middle portion 22*b*, 26*b*, and a lower portion 22*c*, 26*c*, respectively.

The half sections 22, 26 are constructed of a lightweight, rigid material which may be selected from the group which includes, but is not limited to wood, plastic, thermoplastic, metal or a metallic-plastic composite. Preferred plastic and thermoplastic materials include polystyrene, polyvinyl chloride (PVC), polypropylene, polyolefin, acrylonitrile-butadiene-styrene (ABS), polyethylene, polyurethane, polycarbonate, or blends thereof, and ABS/Nylon blend. The half sections 22, 26 may further be constructed utilizing a common molding process such as injection molding, blow molding, extrusion, or other molding and fabricating methods.

The housing 20 may further comprise an enlarged opening 117 defined through the first half section 22 or the second half section 26. A removable panel 116 or door is detachably affixed to half section 22 or 26 so as to cover completely enlarged opening 117. The enlarged opening 117 is shown herein as being defined through second half section 26, with removable panel 116 being detachable affixed thereto and effectively covering enlarged opening 117. The panel 116 may be detachably affixed to half section 22 or 26 via a suitable fastener 116*a*, e.g., one or more screws, a snap-fit arrangement, mechanical interference-type fit, or other suitable attaching means.

The continuous sidewall 24 of first half section 22 and continuous sidewall 28 of second half section 26 each forming a perimeter, the perimeters having a shape being mirror images of one another. The continuous sidewalls 24 and 28 extend integrally into horizontal interface surfaces 23 and 27, respectively, along respective inner sides of the half sections 22 and 26.

Figure 5:
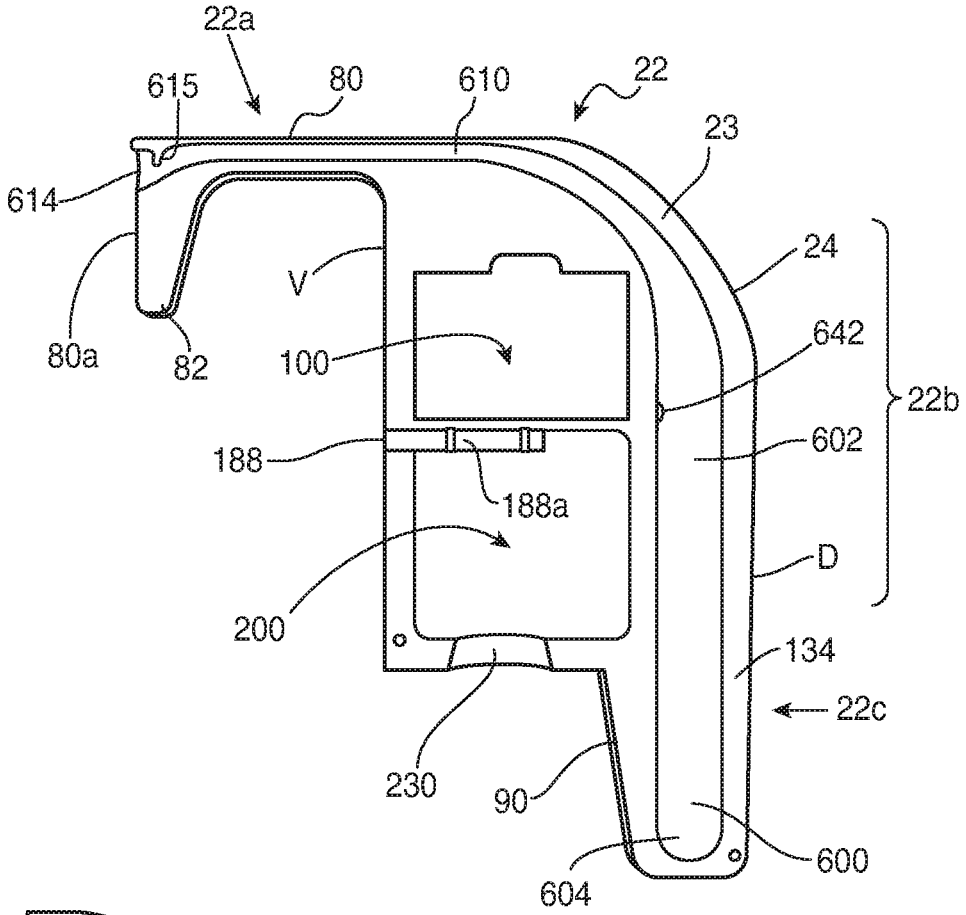
FIG. 5 is an interior side perspective view of the first half section of FIG. 3 shown with the power source, electric motor, and pump removed, in accordance to one embodiment of the present invention.
Figure 17:
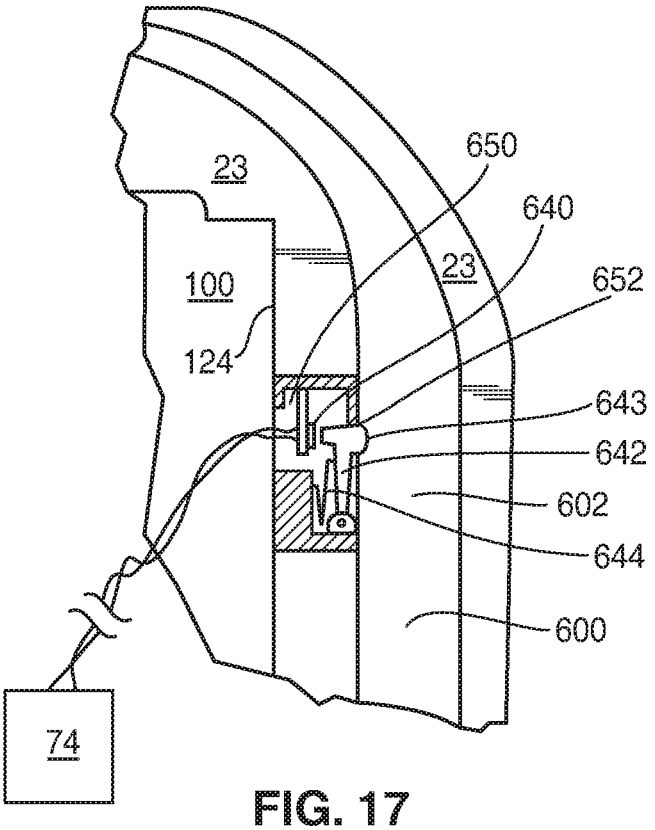
FIG. 17 is a partial cross-sectional view of taken of a portion of first half section illustrating a control switch for activating the motor, in accordance to one embodiment of the present invention.
Figure 6:
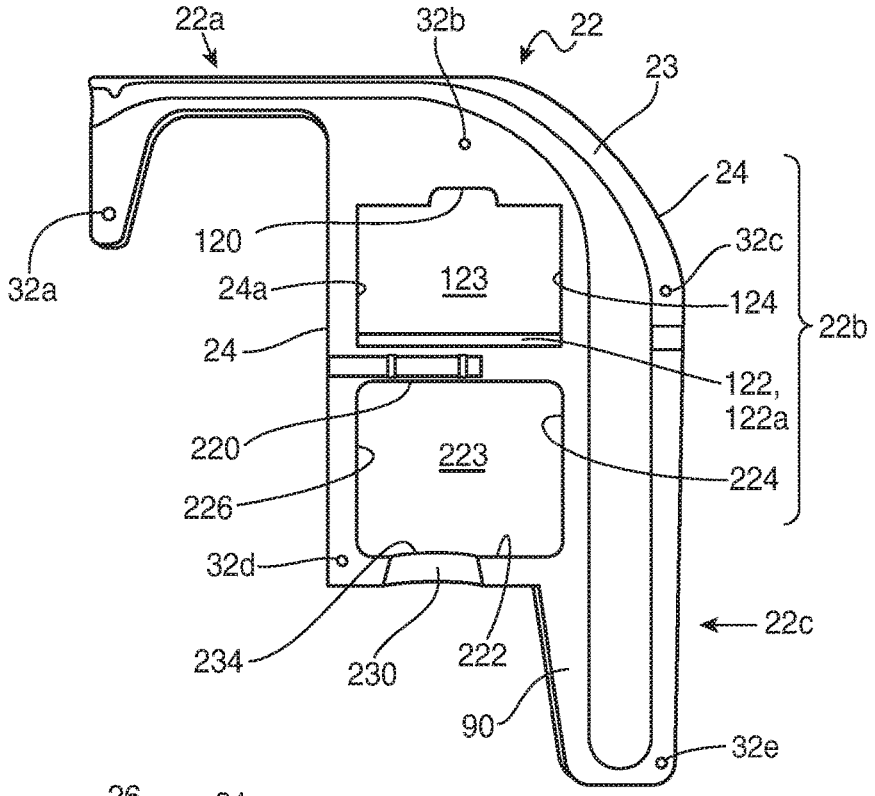
FIG. 6 is an interior side perspective view of the first half section of FIG. 5 illustrating walls which integrally form a first and second compartment, in accordance to one embodiment of the present invention.
Figure 7:
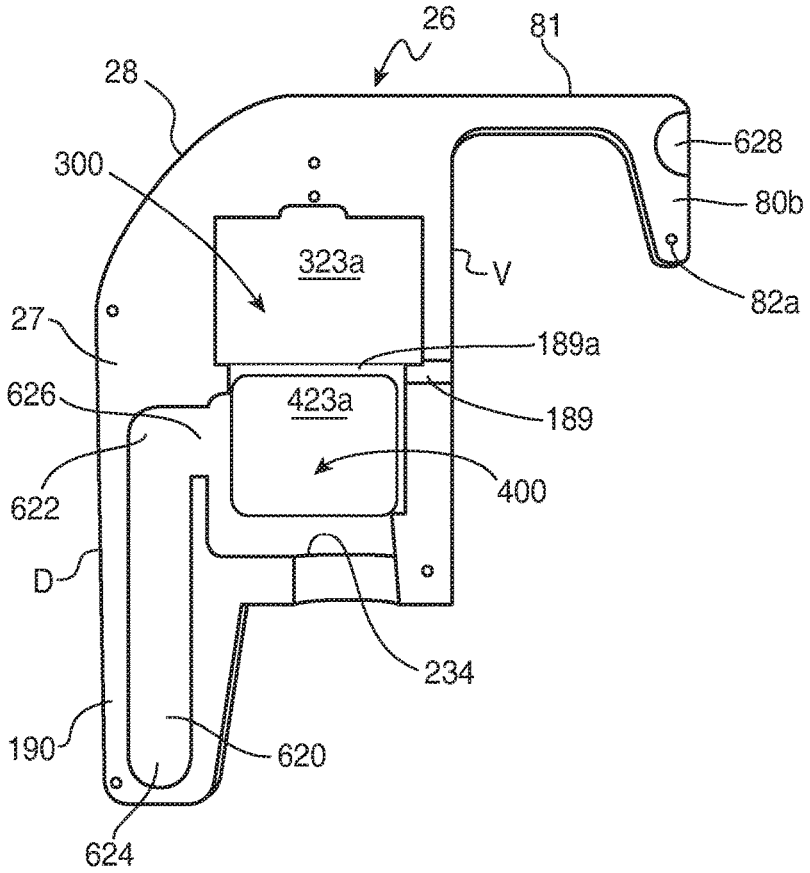
FIG. 7 is an interior side perspective view of the second half section of FIG. 4 illustrating mutually cooperative first and second compartments, in accordance to one embodiment of the present invention.
Figure 6A:
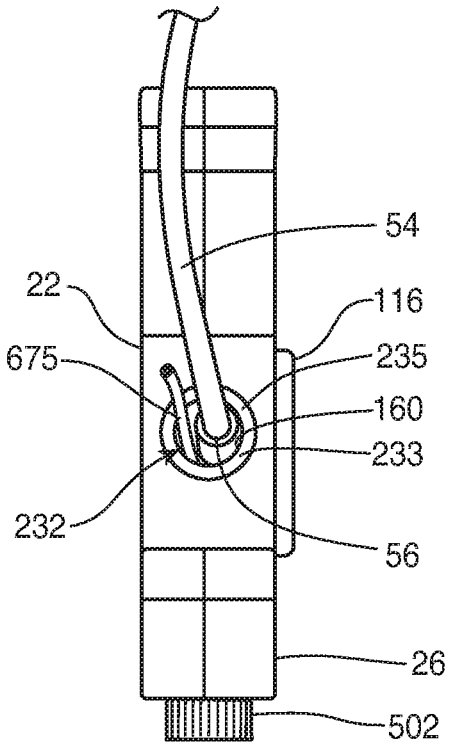
FIG. 6A is a bottom plan view of the housing of the personal hygiene device illustrating an opening thereof for accommodating a container adapter, in accordance to one embodiment of the present invention.
Figure 6B:
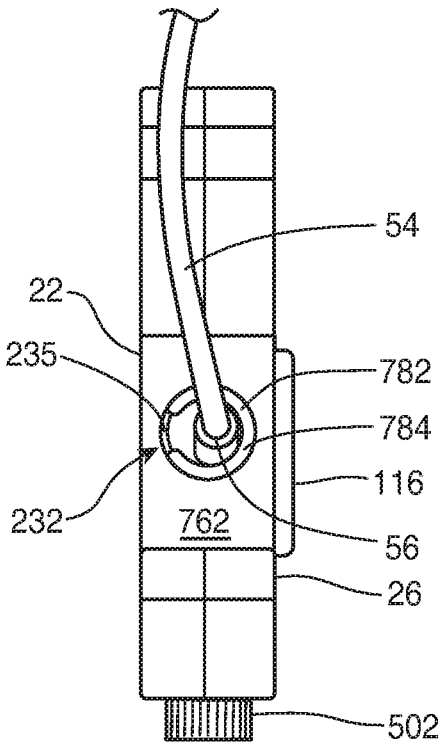
FIG. 6B is a bottom plan view of the housing of the personal hygiene device illustrating a reservoir coupling mechanism, in accordance to another embodiment of the present invention.

Referring now more specifically to FIGS. 5 and 7, integrally molded bracket portions 80 and 81 project forwardly from about the upper portion 22*a*, 26*a* of the half sections 22, 26, respectively. The bracket portions 80 and 81 are formed integral by respective continuous walls 24 and 28, and the bracket portions 80 and 81 terminate at respective distal ends thereof with a downwardly extending arm 80*a*, 80*b*, the arms 80*a*, 80*b* each tapering in a direction from a top side thereof to a nadir 82, 82*a* (bracket portions 80 and 81 to be described later in greater detail).

Referring now to FIGS. 1, and 3-8, the half sections 22 and 26 intimately adjoin along horizontal interface surfaces 23 and 27, respectively, and are connected by a fastening means 30 such as a screw 32 or bolt which extends into apertures 32*a*, 32*b*, 32*c*, 32*d*, and 32*e* defined through abutting housing section 22 and threadedly engages cooperatively-aligned, threaded openings 36*a*, 36*b*, 36*c*, 36*d*, and 36*e* in abutting housing section 26. Detaching or removing removable panel 116 provides user with direct access into the first interior chamber 12 and second interior chamber 14 without disconnecting first half section 22 from second half section 26.

The middle portion 22*b* of half section 22 includes an integrally molded first compartment 100 for retaining a power source 70. In accordance to one exemplary embodiment, the first compartment 100 is dimensionally-sized to snugly accommodate and retain a power source housing 72 therein, the power source 70 being disposed within the housing 72. The compartment 100 is defined by an inner side surface 24*a* of continuous sidewall 24, a longitudinal wall 124 opposing inner side surface 24*a*, and a first horizontal wall 120 opposing a second horizontal wall 122. The compartment 100 further defines an integrally molded recessed floor 123 from which the inner side surface 24*a* of continuous sidewall 24, longitudinal wall 124, first horizontal wall 120, and second horizontal wall 122 upwardly depend. In accordance to one embodiment, the second horizontal wall 122 may extend perpendicularly from the floor 123 to a length exceeding vertically the horizontal plane along which continuous sidewall 24 resides.

In accordance to another embodiment, the second horizontal wall 122 may be defined as a removable support shelf 122*a* upon which the power source housing 72 is supported or suitably mounted. The removable support shelf 122*a* may extend perpendicularly from the floor 123 to a length exceeding vertically the horizontal plane along which continuous sidewall 24 resides.

The middle portion 22*b* of half section 22 further includes an integrally molded second compartment 200 for retaining an electric motor 74 and pump 50. In accordance to one exemplary embodiment, the second compartment 200 is dimensionally-sized to accommodate and retain the motor 74 and pump 50 therein. The second compartment 200 is defined by a first longitudinal wall 224 opposing a second longitudinal wall 226, a first horizontal wall 220 opposing a partially-extending second horizontal wall 222, wherein the walls 224, 226, 220, and 222 being formed or molded integral by the continuous sidewall 24. A recessed gain, shown herein as a concavity 230, extends integrally between the partially-extending second horizontal wall 222 and the second longitudinal wall 226 of second compartment 200.

The second compartment 200 further defines an integrally molded recessed floor 223 from which the continuous sidewall 24, first longitudinal wall 224, second longitudinal wall 226, first horizontal wall 220, and partially-extending second horizontal wall 222 upwardly depend. The concavity 230 is oriented in a plane parallel to the plane in which the floors 123 and 223 of the first and second compartments 100 and 200, respectively, lie.

In accordance to one embodiment, the partially-extending second horizontal wall 222 may extend perpendicularly from the floor 223 to a length exceeding vertically the horizontal plane along which continuous sidewall 24 resides.

The lower portion 22*c* of half section 22 comprises an integrally molded tail extension 90 which projects downwardly at a slightly angular pitch, the extension 90 extending from the second horizontal wall 222 along the continuous sidewall 24 of the dorsal side D of half section 22.

The middle portion 26*b* of half section 26 includes an integrally molded complementary first compartment 300 for retaining the power source 70. In accordance to one exemplary embodiment, the complementary first compartment 300 is dimensionally-sized to snugly accommodate and retain the power source housing 72 therein. The complementary first compartment 300 is defined by an inner side surface 28*a* of continuous sidewall 28, a longitudinal wall 324 opposing inner side surface 28*a*, and a horizontal wall 320 integrally molded perpendicular to the inner side surface 28*a* of continuous wall 28 and longitudinal wall 324. The compartment 100 further defines an integrally molded recessed floor 323 from which inner side surface 28*a* of the continuous sidewall 28, longitudinal wall 324, and horizontal wall 320 upwardly depend.

In specific reference to FIG. 7, with respect to the previously described embodiment which includes the second half section 26 comprising a removable panel 116, the middle portion 26*b* of half section 26 of such embodiment comprises the complementary first compartment 300 which includes a recessed floor 323*a*, wherein the floor 323*a* is defined as an upper section of the inner surface of removable panel 116, and wherein the inner side surface 28*a* of the continuous sidewall 28, longitudinal wall 324, and horizontal wall 320 upwardly depend from the floor 323*a*.

Referring now more particularly to FIGS. 1, and 5-9, the middle portion 26*b* of half section 26 further includes an integrally molded complementary second compartment 400 for retaining the electric motor 74 and pump 50. Upon secure intimate connection of first half section 22 to second half section 26, the compartments 100, 200 and 300, 400 of both respective half sections 22 and 26 conjunctively form the first interior chamber 12 enclosing the power source 70 therein, and the second interior chamber 14 enclosing the motor 74 and pump 50 therein. In addition, the bracket portions 80 and 81 conjunctively form a mounting bracket 83 for fitting over and frictionally engaging an inner rim side edge 7*a*, an outer rim side edge 8, and an upper rim surface edge 6 of the rim 5*a* of the toilet bowl 5, thereby detachably securing the hygiene device 10 to the toilet bowl 5. The mounting bracket 83 is positioned under the toilet seat 6*a*, and then detachably secured to the rim 5*a* of toilet bowl 5, as previously described. Once the hygiene device 10 is properly installed, the toilet seat 6*a* may remain in a raised position or a lowered position during use of the present invention. The mounting bracket 83 comprises a generally C-shaped member 84 having a rim engaging surface 85, and a forward portion or face 86, the rim engaging surface 85 frictionally engaging the toilet rim 5*a* and being securably retained thereto via mechanical interference fit. The width W1 between opposing rim engaging surfaces 85 of C-shaped member 84 is less than the width W2 of the toilet rim 5*a*.

Figure 25:
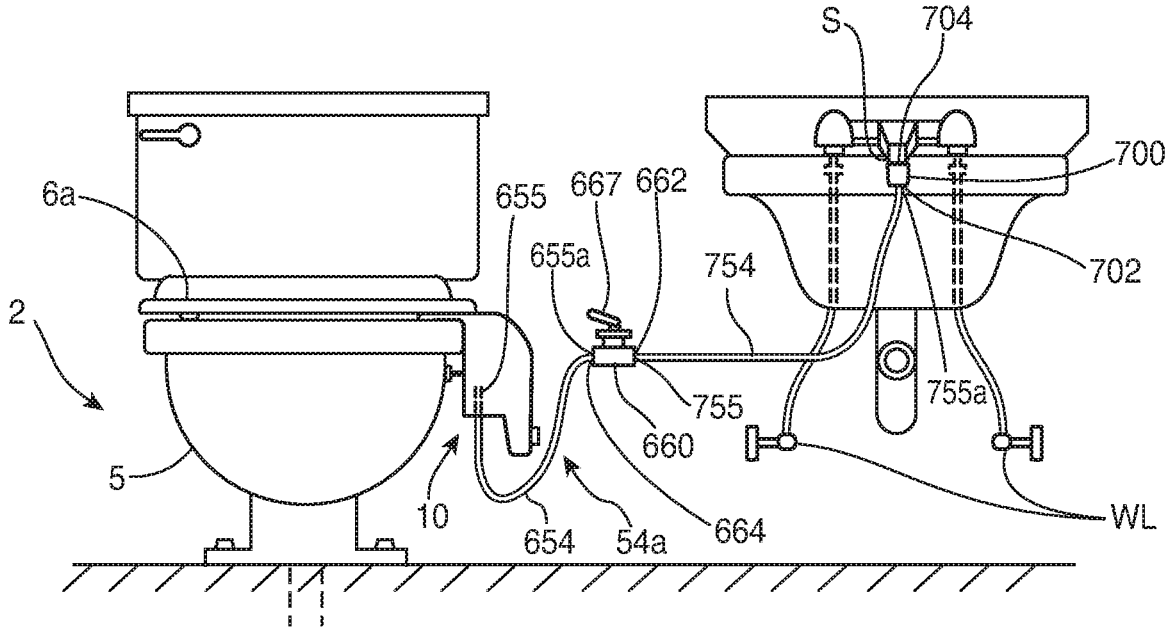
FIG. 25 is a front elevational view of a personal hygiene device shown removably attached to a toilet fixture, the hygiene device is detachably connected and in fluid communication with a conventional water line, according to an alternate embodiment of the present invention.

Alternatively, the bracket portions 80 and 81 conjunctively form a mounting bracket 83 for fitting over and slidably engaging the inner rim side edge 7*a*, the outer rim side edge 8, and the upper rim surface edge 6 of the toilet rim 5*a* of the toilet bowl 5. As depicted in FIG. 25, positioning the toilet seat 6*a* in the downward seating position superjacent the mounting bracket 83 holds the hygiene device 10 in place.

Figure 10:
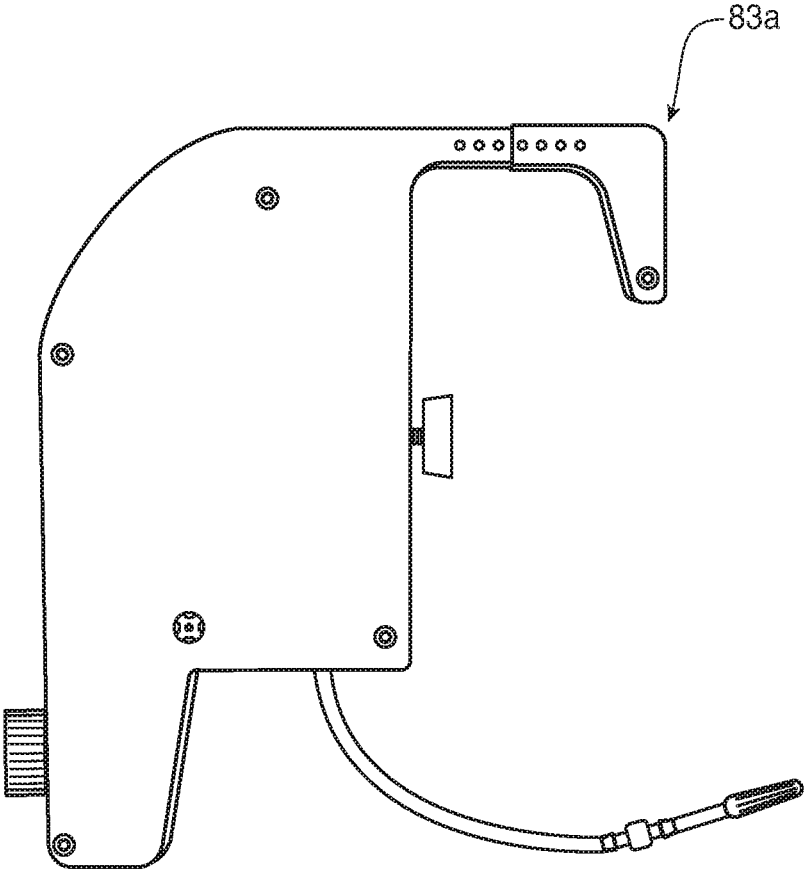
FIG. 10 is a right side perspective view of a personal hygiene device having a telescopic bracket, in accordance to one embodiment of the present invention.
Figure 11:
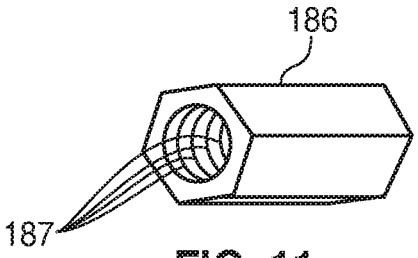
FIG. 11 is a perspective view of a receiver element of an adjustable brace, in accordance to one embodiment of the present invention.
Figure 12:
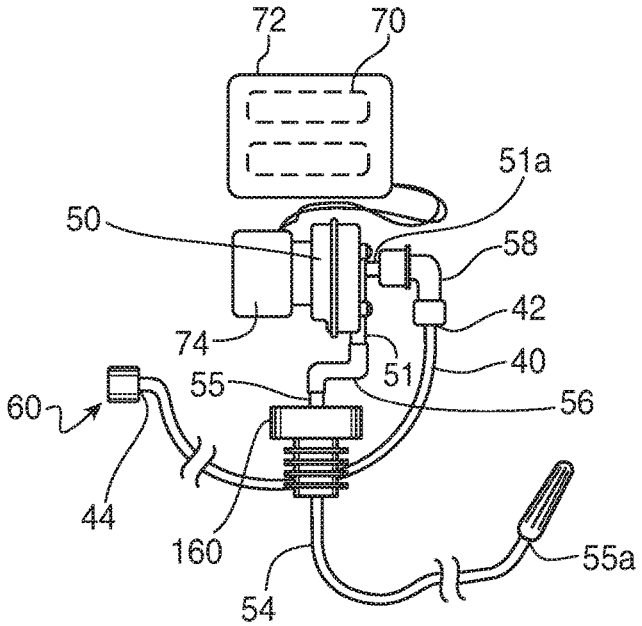
FIG. 12 is a perspective view of the power source, motor, pump, and plurality of conduit in connection with pump, in accordance to one embodiment of the present invention.
Figure 13:
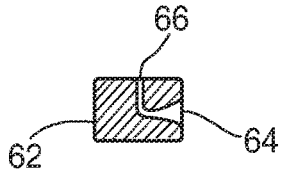
FIG. 13 is cross-sectional view of a spray nozzle, in accordance to one embodiment of the present invention.
Figure 14:
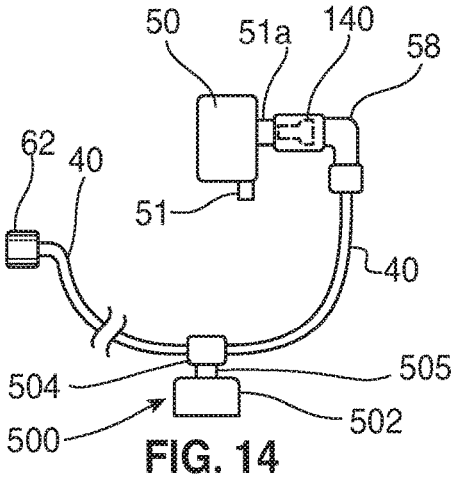
FIG. 14 is perspective view of a discharge control and adjustment mechanism, in accordance to one embodiment of the present invention.

In accordance to one embodiment, the bracket 83*a* is telescopically adjustable so as to allow for a plurality of selectively-desired, latitudinal setting positions thereof (telescopic bracket 83*a* shown in FIG. 10). The telescopic bracket 83*a* comprises a linearly elongated inner cylinder telescopically received by a linearly elongated outer cylinder. The pair of cylinders includes a series of spatially aligned holes which cooperate with a locking mechanism, such as a spring-biased pin assembly that permits a pin thereof to extend through the holes of the pair of cylinders and be utilized to secure the cylinders at a selectively-desired latitudinal or horizontal orientation. In a resting position, the pin is urged by a biasing means, e.g., a spring, inwardly towards respective cylinders. In order to telescopic adjust the pair of cylinders, the pin is retracted or pulled axially until pin is effectively removed from the holes in both cylinders. The locking mechanism may alternatively be a spring-biased detent assembly or other locking mechanism suitable for detachably securing the cylinders about a selectively desired latitudinal position.

With specific reference to FIGS. 5, 7-9, and 11, to further enhance secured attachment of hygiene device 10 to the toilet rim 5*a*, an adjustable brace 180 is provided. The brace 180 is movable between retracted and extended positions. More specifically, the brace 180 is adapted to be extended axially away from the ventral side V of the housing 20 to engage the outer surface of toilet bowl 5, and subsequently retracted into the housing 20. In accordance to one embodiment, the adjustable brace 180 comprises a rotatable handle 182 to which an elongated shaft 184 is mounted, the shaft 184 engages an annular receiver 186. The shaft 184 includes a plurality of external threads 185, and the receiver 186 includes a plurality of complementary internal threads 187. The external threads 185 of shaft 184 are mateably engagable with the internal threads 187 of receiver 186. In this manner, the shaft 184 is selectively extendable and retractable by threading and unthreading the mutually complementary threads 185 and 187. The handle 182 is preferably constructed of a semi-rigid, pliable material, such as rubber, so as to firmly grip the outer surface of toilet bowl 5 when the brace 180 is threaded to an extended position in firm contact with bowl 5, while also providing a handle 182 sufficiently rigid so as to allow the brace 180 to be extended and retracted via the handle 182.

The receiver 186 is suitably disposed and/or affixed in an axially oriented concave fossa 188 formed integral in first half section 22 between the first compartment 100 and second compartment 200 thereof, along the ventral side V of continuous sidewall 24, wherein the fossa 188 extending contiguously into an integrally formed, axially oriented elongated channel 188*a*. The second half section 26 includes an axially oriented concave fossa 189 formed integral thereto between the complementary first compartment 300 and complementary second compartment 400, along the ventral side V of continuous sidewall 28, wherein the wherein the fossa 189 extending contiguously into an integrally formed, axially oriented elongated channel 189*a*. Fossas 188 and 189 conjunctively form a receiver compartment 189*b* upon secure intimate connection of first half section 22 to second half section 26.

Referring now to FIGS. 2-7, 9, and 10, in accordance to one exemplary embodiment, the complementary second compartment 400 is dimensionally-sized to snugly accommodate and retain the motor 74 and pump 50 therein. The complementary second compartment 400 is defined by a longitudinal wall 424 opposing a partially-extending longitudinal wall 426, and a partially-extending horizontal wall 428 formed integral by the continuous sidewall 28, the partially-extending horizontal wall 428 being integrally molded perpendicular to partially-extending longitudinal wall 426. A recessed gain, shown herein as a concavity 429, extends integrally between the partially-extending horizontal wall 428 and the longitudinal wall 424 of complementary second compartment 400. The complementary second compartment 400 further defines an integrally molded recessed floor 423 from which the longitudinal wall 424, partially-extending longitudinal wall 426, and partially-extending horizontal wall 428 upwardly depend. The concavity 429 is oriented in a plane parallel to the plane in which the floors 323, 323*a* and 423, 423*a* of complementary first and second compartments 300 and 400, respectively, lie.

Upon secure intimate connection of first half section 22 to second half section 26, the concavities 230 and 429, of both respective second compartment 200 and complementary second compartment 400 of half sections 22 and 26, conjunctively form an opening 232, shown herein as a generally circular opening 232. The opening 232 has a mouth 233 which includes an upper surface 234 opposing a lower surface 235. The opening 232 provides direct and open passage from an exterior or outside of housing 20 into the second interior chamber 14. The opening 232 is diametrically sized so as to provide a space for receiving and affixing a container adapter 160, a reservoir closure cap 1160, and an annular collar 1162 of a reservoir 110. The container adapter 160 provides a means for detachably connecting a reservoir 110 to the housing 20 in sealed, airtight relationship. The container adapter 160, reservoir closure cap 1160, and annular collar 1162 shall be described later in greater detail.

In specific reference to FIG. 7, with respect to the previously described embodiment which includes the second half section 26 comprising a removable panel 116, the complementary second compartment 400 comprises a recessed floor 423*a*, wherein the floor 423*a* is defined as a lower section of the inner surface of removable panel 116, and wherein the longitudinal wall 424, the partially-extending longitudinal wall 426, and the partially-extending horizontal wall 428 upwardly depend from the floor 423*a*.

The lower portion 26*c* of half section 26 comprises an integrally molded tail extension 190 which projects downwardly at a slightly angular pitch, the extension 190 extending from the partially-extending horizontal wall 428 along the continuous sidewall 28 of the dorsal side D of half section 26.

Referring now more particularly to FIGS. 3, 9, and 12-13, a flexible, retractable discharge conduit 40 interconnects a nozzle assembly 60 with the pump 50. The pump 50 is disposed within the second compartment 200 and transfers water 7 from a reservoir 110 to the discharge outlet 66 of the nozzle assembly 60, wherein pump 50 is in fluid communication with the conduit 40 and nozzle assembly 60.

In accordance to one embodiment, the electric motor 74 and pump 50 may be mounted to a mounting frame plate 227 (shown in FIG. 3) which is secured perpendicularly to the floor 223 and/or first horizontal wall 220 of second compartment 200.

In accordance to another embodiment, the electric motor 74 and pump 50 may be mounted along lower sides thereof to a support platform, or a pair of spaced support brackets 228, 229 (also shown in FIG. 3) which is secured perpendicularly to the floor 223 of second compartment 200.

The pump 50 is driven by the electric motor 74 which is powered via a power source 70, such as batteries or rechargeable batteries. The electric motor 74 is connected via wiring across two terminals of the power source 70. In order to activate electric motor 74 to drive pump 50, a control switch 640 is depressed, the control switch 640 and motor 74 being electrically interconnected via wiring.

The pump 50 draws water 7 from the reservoir 110 via a flexible intake conduit 54 and transfers the water 7 into the flexible, retractable discharge conduit 40 through which water 7 is delivered to the nozzle assembly 60. A tubular, first elbow fitting 56 connects the pump 50 to the flexible conduit 54. The pump 50 includes an inlet port 51 to which one end of the first elbow fitting 56 is connected in an airtight sealed fashion, the other end of first elbow fitting 56 is connected to an outlet 55 of flexible conduit 54 in an airtight sealed fashion. Flexible conduit 54 includes an inlet 55*a* through which water 7 is drawn from the reservoir 110. The pump 50 further includes an outlet port 51*a* to which one end of a second elbow fitting 58 is connected in an airtight sealed fashion, the other end of second elbow fitting 58 is connected to an inlet 42 of flexible, retractable conduit 40 in an airtight sealed fashion.

The nozzle assembly 60 comprises a spray nozzle 62 comprising an inlet 64 and a discharge outlet 66, the inlet 64 extending contiguous and in direct fluid communication with the discharge outlet 66. The inlet 64 of nozzle 62 is connected to an outlet 44 of flexible, retractable conduit 40 and in fluid communication therewith, wherein the inlet 64 of nozzle 62 and outlet 44 of conduit 40 are connected in an airtight sealed fashion.

Referring now more specifically to FIGS. 1-3, 5, and 7, the hygiene device 10 further comprises a discharge control and adjustment mechanism 500, wherein the mechanism 500 is manipulated to extend the nozzle assembly 60 and discharge conduit 40 outside the housing 20 to a liquid discharge or delivery position DP (shown in FIG. 9) and to fully retract the nozzle assembly 60 and conduit 40 into housing 20. The discharge control and adjustment mechanism 500 is fixedly secured around a length of discharge conduit 40 distal to nozzle assembly 60. The discharge control and adjustment mechanism 500 comprises a knob 502 coupled to discharge conduit 40 via a flanged fitting 504.

The horizontal interface surface 23 of first half section 22 is integrally formed with a recessed channel 600 extending longitudinally along the tail extension 90, the recessed channel 600 having a proximal end 602 and a distal end 604, wherein the proximal end 602 of recessed channel 600 extending contiguously to a discharge conduit guide channel 610 about which discharge conduit 40 translates, the discharge conduit guide channel 610 formed integral in section 22 and extending upward curvilinearly and terminating at a nozzle recess 614.

The horizontal interface surface 27 of second half section 26 is integrally formed with a complementary recessed channel 620 extending longitudinally along the tail extension 190, the complementary recessed channel 620 having a proximal end 622 and a distal end 624, wherein the proximal end 622 of recessed channel 620 extending contiguously to an axially oriented portal 626 in open fluid communication with the complementary second compartment 400. The recessed channel 600 of first half section 22 and complementary recessed channel 620 of second half section 26 conjunctively form a guide chamber 627 for receiving the flanged fitting 504 of discharge control and adjustment mechanism 500 upon secure intimate connection of first half section 22 to second half section 26.

Second half section 26 further comprises a complementary nozzle recess 628 formed integral in the arm 80*b* of bracket portion 81, wherein the complementary nozzle recess 628 oriented distal to nadir 82*a*. The nozzle recess 614 of first half section 22 and nozzle recess 628 of second half section 26 conjunctively form a nozzle retaining cavity 630 for receiving the nozzle assembly 60 upon secure intimate connection of first half section 22 to second half section 26. The nozzle retaining cavity 630 is shaped to accommodate the contour of nozzle assembly 60.

An integrally molded abutment rib 615 (best illustrated in FIG. 5) extends radially into the discharge conduit guide channel 610 and engages a rear side of spray nozzle 62 to prevent nozzle assembly 60 from retracting passed the nozzle retaining cavity 630 when nozzle assembly 60 is retracted to a stowed position.

Figure 1:
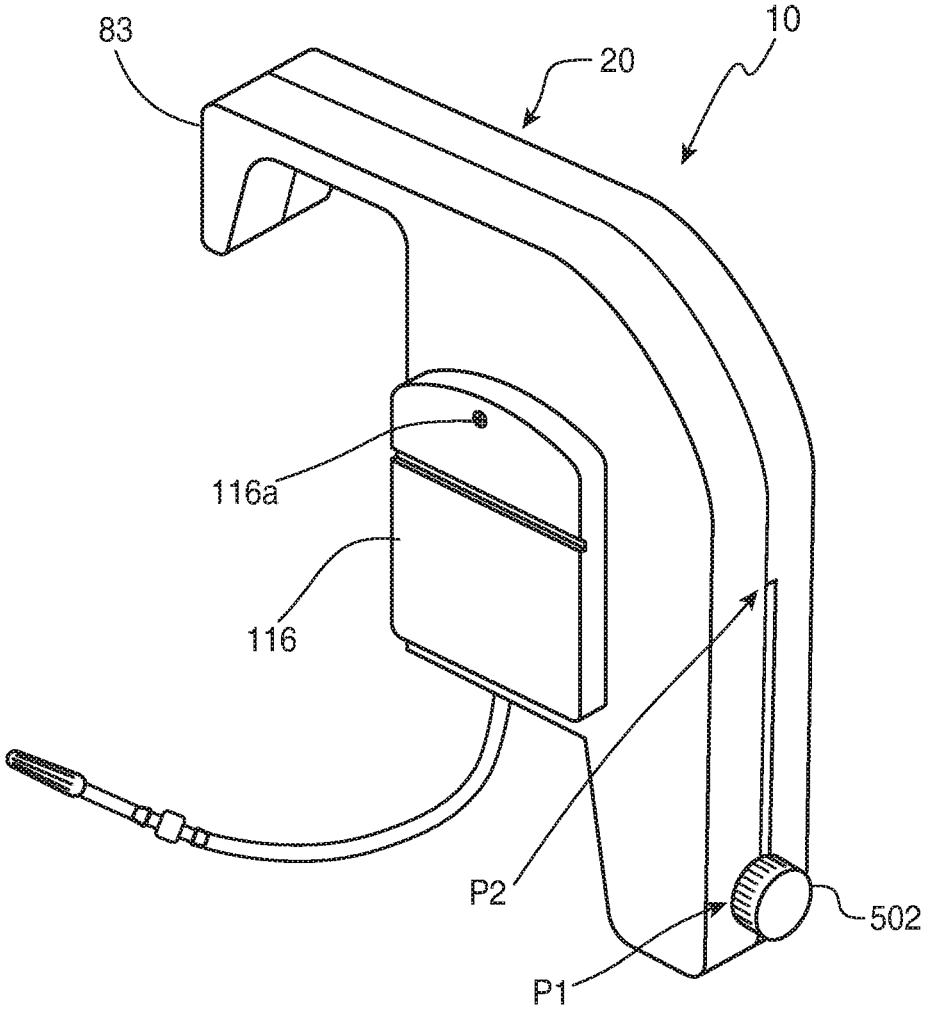
FIG. 1 is a left, rear perspective view of a personal hygiene device, according to one embodiment of the present invention.
Figure 9:
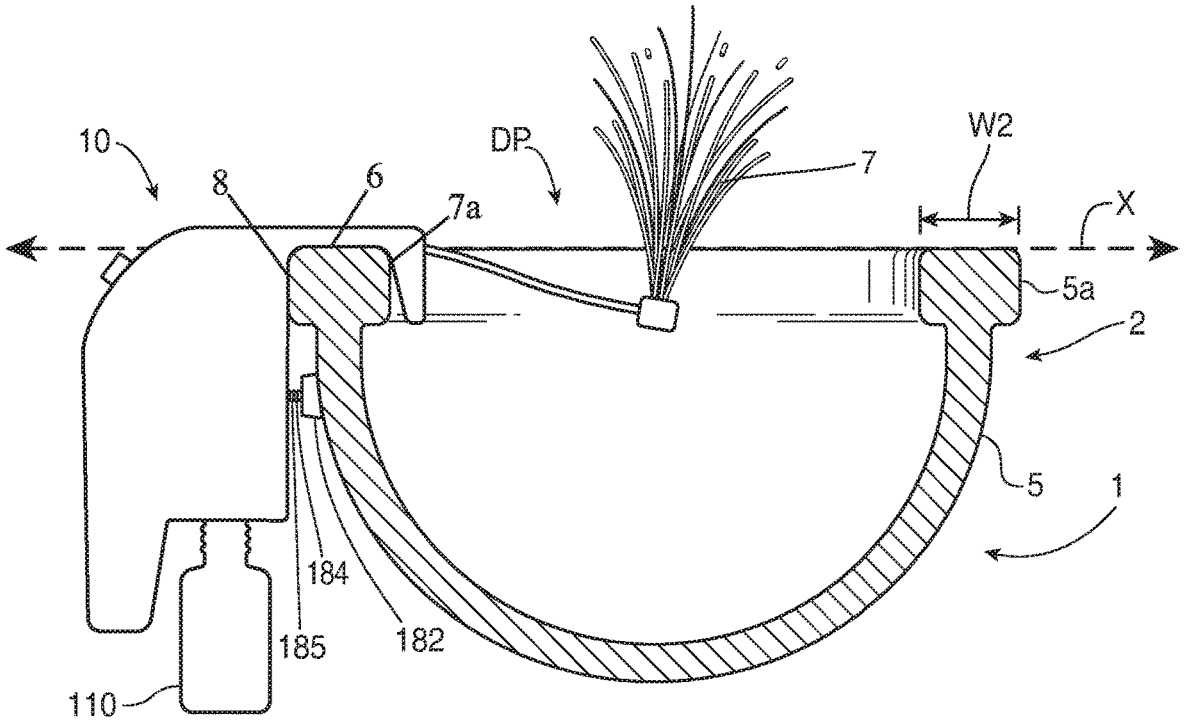
FIG. 9 is a partial cross-sectional view of a toilet bowl of a conventional toilet fixture to which the personal hygiene device is shown detachably secured thereto and in-use, in accordance to one embodiment of the present invention.

The nozzle assembly 60 and discharge conduit 40 are slidably movable between a fully retracted position, where the nozzle assembly 60 is received in the nozzle retaining cavity 630, discharge conduit 40 is received in guide channel 610, and flanged fitting 504, of discharge control and adjustment mechanism 500, is received in the guide chamber 627, as best illustrated in FIGS. 2-3, and 5-8; and an extended position where the nozzle assembly 60 and discharge conduit 40 extend outwardly away from the face 86 of mounting bracket 83 angularly downward at an angle measuring approximately 45° to the horizontal axis X so as to extend into the toilet bowl 5 at the liquid discharge position DP, as shown in FIG. 9. When nozzle assembly 60 and discharge conduit 40 are resting in a fully retracted position inside housing 20, the knob 502 is positioned at position one (P1) (FIG. 1), and when nozzle assembly 60 and discharge conduit are extended so as to be oriented in the liquid discharge position DP, the knob 502 is positioned at position two (P2) (FIG. 1).

Figure 16:
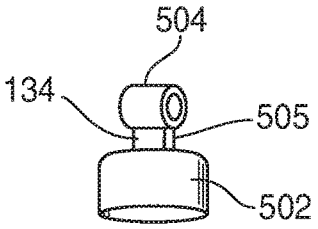
FIG. 16 is a perspective view of a discharge control and adjustment mechanism, in accordance to another embodiment of the present invention.
Figure 18:
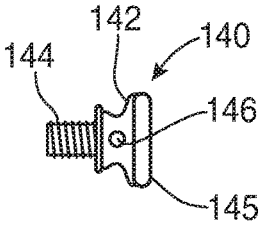
FIG. 18 is a side elevational view of a control valve, in accordance to one embodiment of the present invention.
Figure 15:
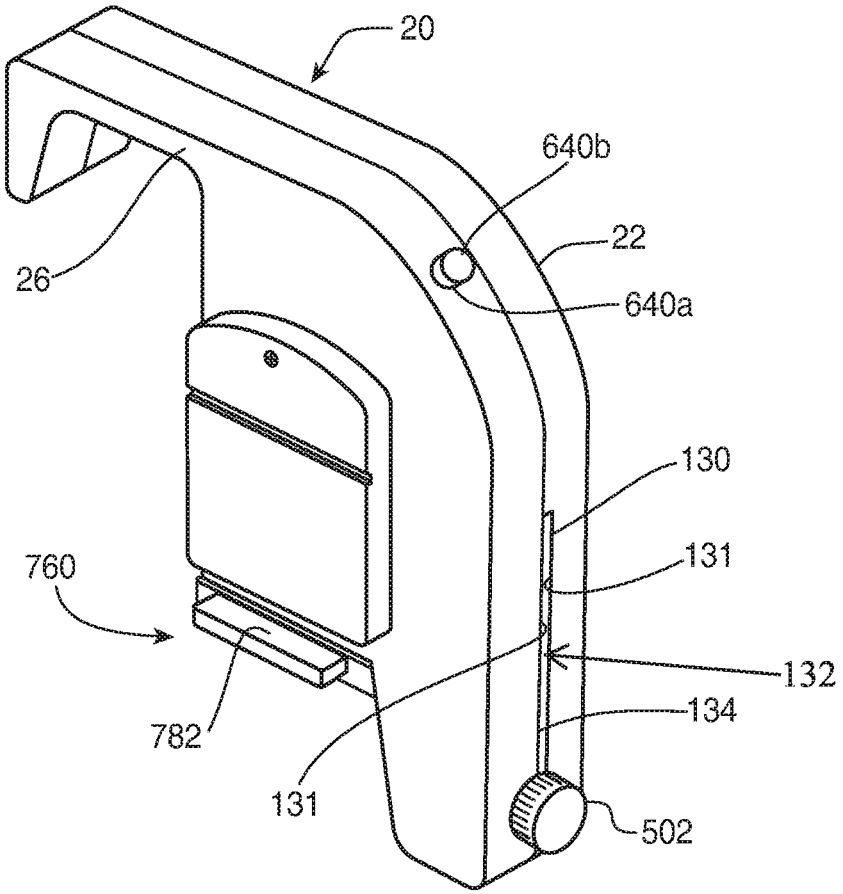
FIG. 15 is a left, rear perspective view of a personal hygiene device, according to another embodiment of the present invention.

The nozzle assembly 60 and discharge conduit 40 are slidably movable between the retracted position and extended position via slidable movement of the knob 502 by user between position P1 and P2, respectively. The mutual cooperation of knob 502 and guide channel 610 allows for any number of selectively-desired, retracted and extended setting positions of the nozzle assembly 60 about the internally open volume provided by toilet bowl 5. First half section 22 may include an elongated recess 130 formed integral therein providing an opening 132 in housing 20 about which planar body 505 of flanged fitting 504 translates to facilitate frictionless movement by flanged fitting 504 about guide chamber 627 during the course of retraction and extension of nozzle assembly 60 and discharge conduit 40. To further facilitate friction-free translation by flanged fitting 504 about the guide chamber 627, it is envisioned a liner 134, membrane, or cover may be disposed on the opposing inner surface edges 131 of the elongated recess 130 and/or body 505 of fitting 504 (FIGS. 15 and 16). The liner 134 is constructed of an ultra-high molecular weight polyethylene polymer material, or similar material which allows the body 505 of fitting 504, and nozzle assembly 60 and discharge conduit 40 to slidably translate about opening 132 and guide chamber 627, respectively, in a frictionless or friction-free manner.

In the extended position, the nozzle assembly 60 is capable of directing a stream of cleansing water 7, via the spray nozzle 62, against the underside of the user who is or may be seated on the toilet seat 6*a*, thereby cleansing the genitals and anal skin areas on the underside of the user.

Figure 19:
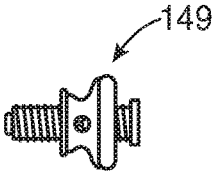
FIG. 19 is a side elevational view of an alternative control valve, in accordance to one embodiment of the present invention.

Referring now more specifically to FIGS. 1-3, 7, 9, 12-14, 16, 17, and 18, according to one embodiment, and as previously described, activation of pump 50 to actuate discharge of a stream of liquid from the spray nozzle 62 is governed via the motor 74 which is electrically connected via wiring to a control switch 640. The control switch 640 is actuated by a switch arm 642 pivotally disposed within a hollow cavity 650 defined perpendicularly through longitudinal wall 124 of compartment 100 of horizontal interface surface 23. A biasing member 644, such as a spring, normally urges the switch arm 642 away from the control switch 640 and towards the recessed channel 600 where the head 643 of switch arm 642 protrudes through a hole 652 in cavity 650, the hole 652 being defined proximal to proximal end 602 of recessed channel 600 and in fluid communication therewith. Depressing the switch arm 642 actuates the control switch 640 to activate or deactivate motor 74, which thereby in turn, respectively starts or stops the pump 50. A control valve 140 may be interposed between outlet port 51*a* of pump 50 and the second elbow fitting 58, the control valve 140 is of a conventional, manually-operated, turnable valve design for controlling the passage of fluid through a through a tubular element, such as a conduit, tube, or pipe. The control valve 140 includes a tubular body 142 having a threaded lower end 144, a radially extending neck 145, and a hole 146 defined through the body 142 between threaded lower end 144 and neck 145. The neck 145 is pivotally coupled to one end of the second elbow fitting 58*a* for turning the body 142 as knob 502 is moved between positions P1 and P2. Turning the body 142 in one direction (e.g., counter-clockwise) causes valve 140 to be in an open position, and turning the body 142 in an opposite direction (e.g., clockwise) causes valve 140 to be in a closed position. With respect to embodiments incorporating the control valve 140, such valve 140 controls liquid flow from the pump 50 to the discharge conduit 40. Other valves and control valves are envisioned, which may include, for example, a poppet valve 149 (shown in FIG. 19).

In order to actuate control switch 640, the switch arm 642 is depressed upon contact by the flanged fitting 504 therewith as the knob 502 is moved upwardly to extend nozzle assembly 60 and discharge conduit 40, and depressed as the knob 502 is moved downwardly to retract the nozzle assembly 60 and discharge conduit 40. In accordance to the instant embodiment, the distance between the knob 502 at position P1 and the switch arm 642 provides user with a delayed liquid discharge period, or delayed timer, the period defined as the time required to slidably move knob 502 from position P1 to P2.

Figure 1A:
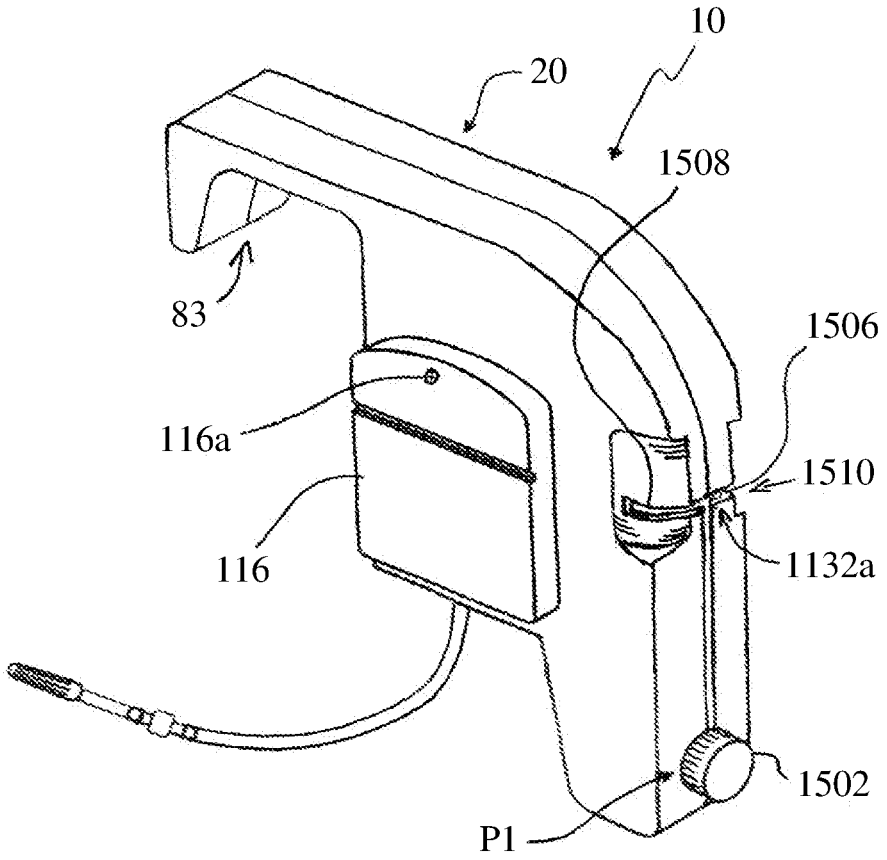
FIG. 1A is a left, rear perspective view of a personal hygiene device, according to another embodiment of the present invention.
Figure 16A:
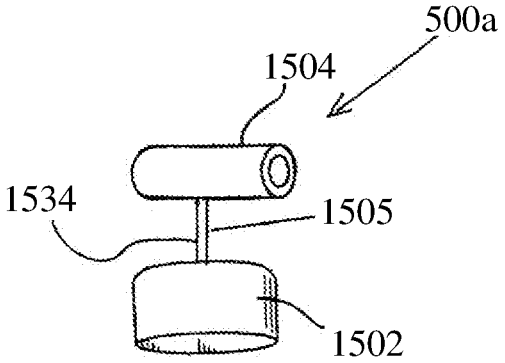
FIG. 16A is a perspective view discharge control and adjustment mechanism, in accordance to another embodiment of the present invention.

In reference to FIGS. 1A, and 16A, in accordance to another embodiment, the nozzle assembly 60 is adapted and configured to oscillate and discharge liquid 7 in a concurrent fashion. Referring now more specifically to FIG. 16A, a discharge control and adjustment mechanism 500*a* is depicted. The mechanism 500*a* comprises a knob 1502 coupled to the discharge conduit 40 via a flanged fitting 1504. The knob 1502 is coupled to the flanged fitting 1504 via a pin 1505, wherein the pin 1505 is mounted perpendicularly at one end thereof about a center of the knob 1502 and to the external circumferential sidewall of the flanged fitting 1504 at an opposing end of the pin 1505.

Figure 1B:
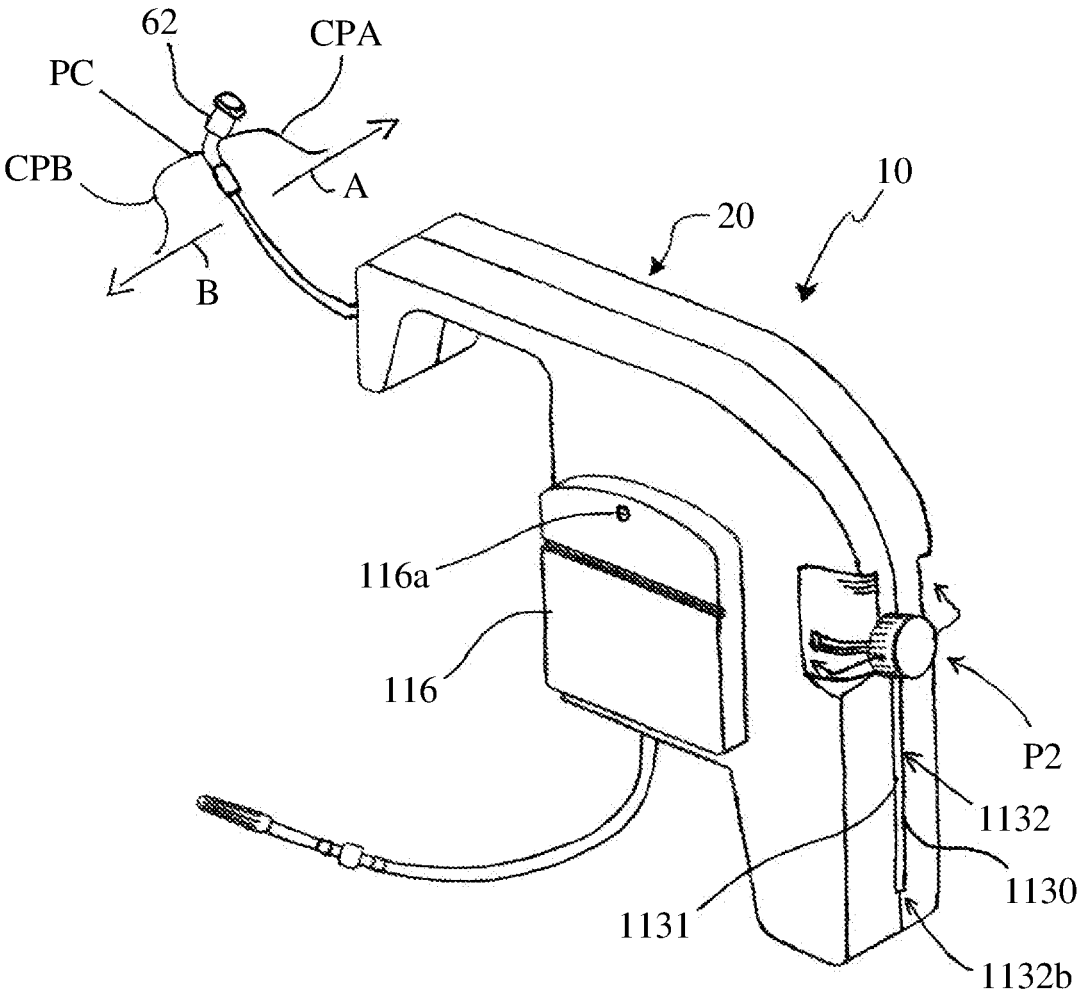
FIG. 1B is a left, rear perspective view of the device of FIG. 1A illustrating the knob moved to the toggle position.
Figure 2:
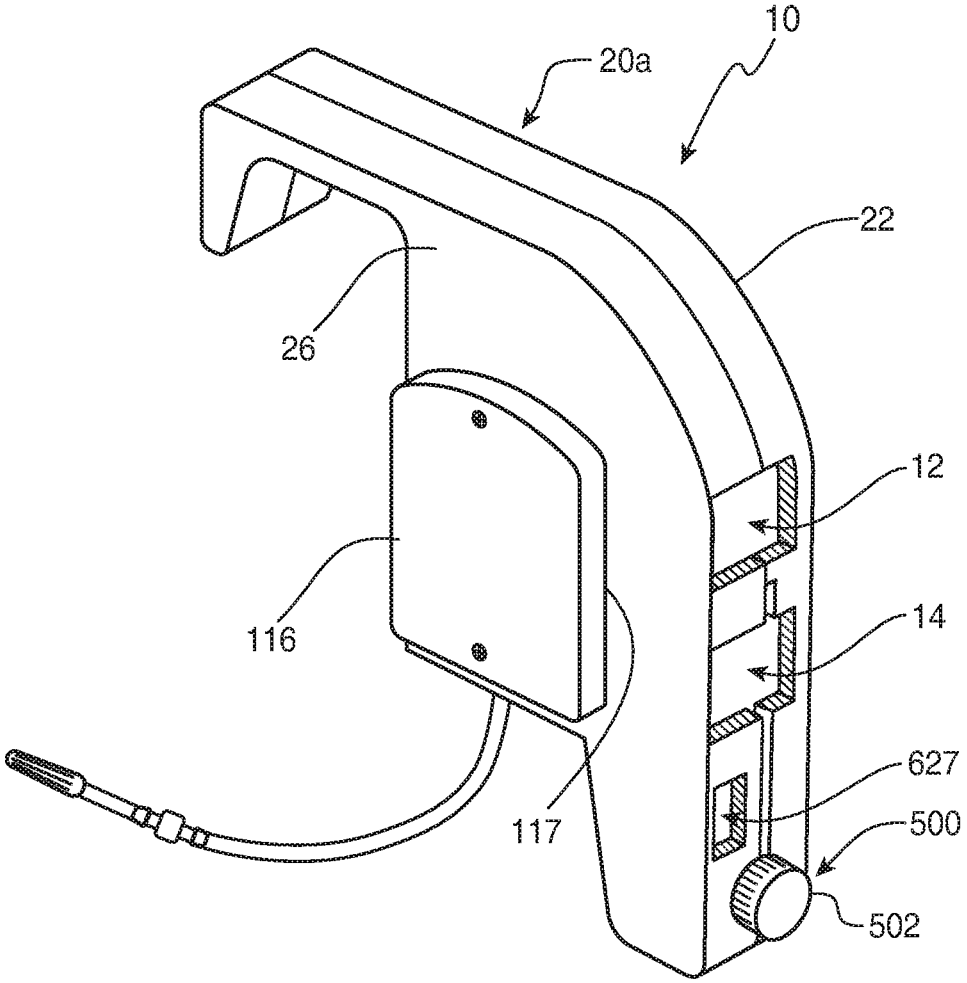
FIG. 2 is a front elevational view of the illustrating the first and second interior chambers of the housing of the device of FIG. 1.
Figure 4:
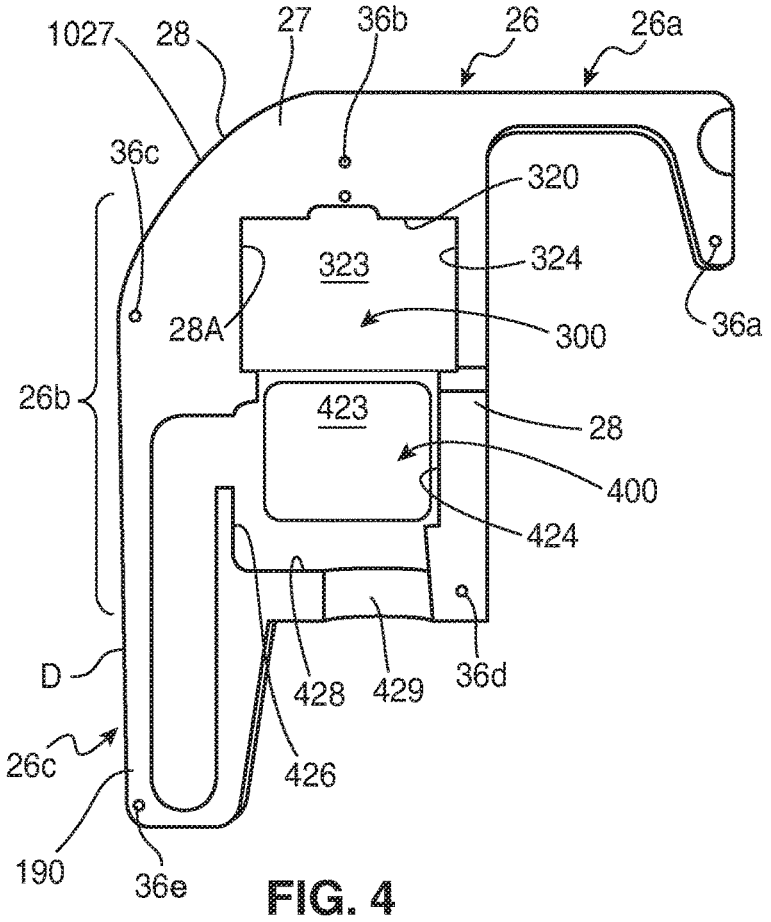
FIG. 4 is an interior side perspective view of a second half section of a housing of the personal hygiene device, in accordance to one embodiment of the present invention.

In further accordance to the embodiment depicted in FIGS. 1A and 1B, the first half section 22 and the second half section 26 each includes an elongated recess 1130 and 1131, respectively, formed integral therein. The elongated recesses 1130 and 1131 conjunctively provide a vertical slot 1132 in the housing 20 along which the pin 1505 of the discharge control and adjustment mechanism 500*a* translates during the course of retraction and extension of nozzle assembly 60 and discharge conduit 40. The vertical slot 1132 includes an upper terminus 1132*a* and a lower terminus 1132*b*.

The first half section 22 and the second half section 26 each further includes a curved opening 1506 and 1508, respectively, oriented perpendicular to the vertical slot 1132. The curved openings 1506 and 1508 conjunctively form a horizontally-oriented toggle slot 1510 along which the pin 1505 of the discharge control and adjustment mechanism 500*a* reciprocates. The toggle slot 1510 is in open, fluid communication with vertical slot 1132. As depicted in FIG. 16A, the pin 1505 may be covered with a liner 1534 or membrane is constructed of an ultra-high molecular weight polyethylene polymer material, or similar material which allows the pin 1505 of discharge control and adjustment mechanism 500*a* to slidably translate along the vertical slot 1132 and reciprocate about the toggle slot 1510 in a substantially frictionless or friction-free manner.

Figure 3:
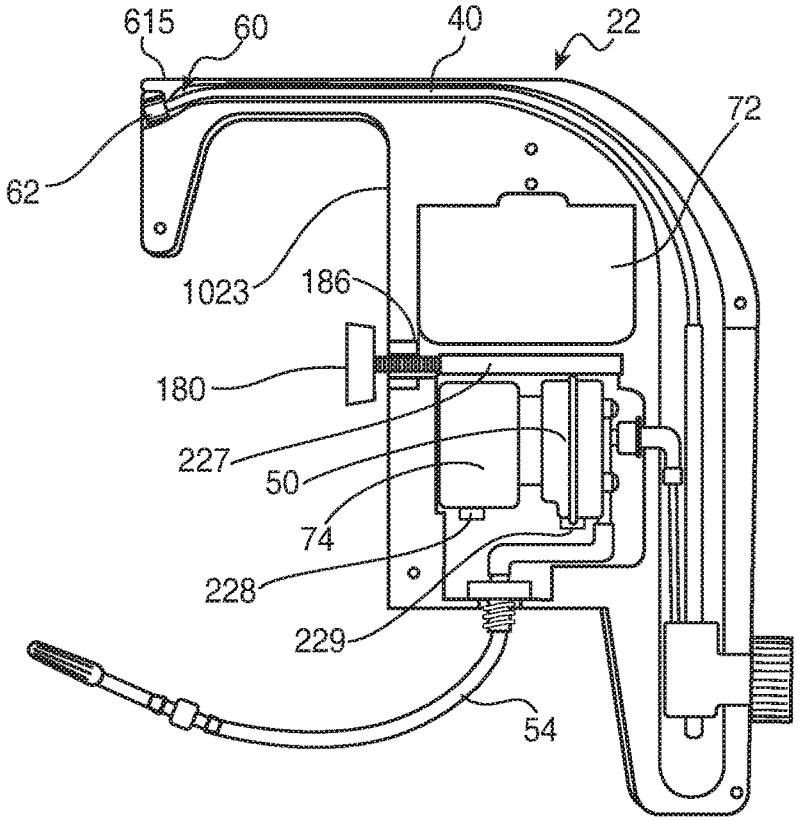
FIG. 3 is an interior side perspective view of a first half section of a housing of the personal hygiene device illustrating a power source, electric motor, and pump disposed therein, in accordance to one embodiment of the present invention.
Figure 3A:
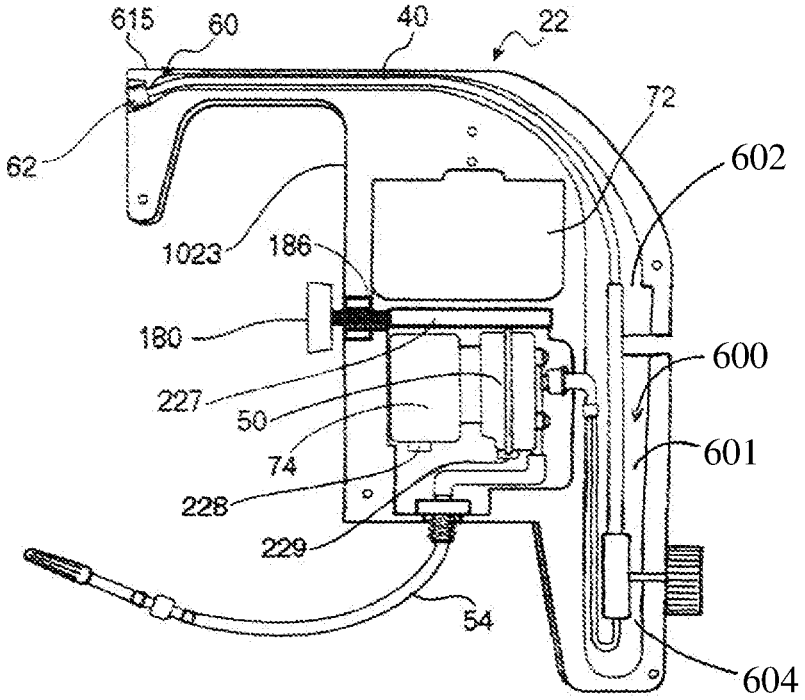
FIG. 3A is an interior side perspective view of a first half section of a housing of the personal hygiene device illustrating a power source, electric motor, and pump disposed therein, in accordance to another embodiment of the present invention.
Figure 3B:
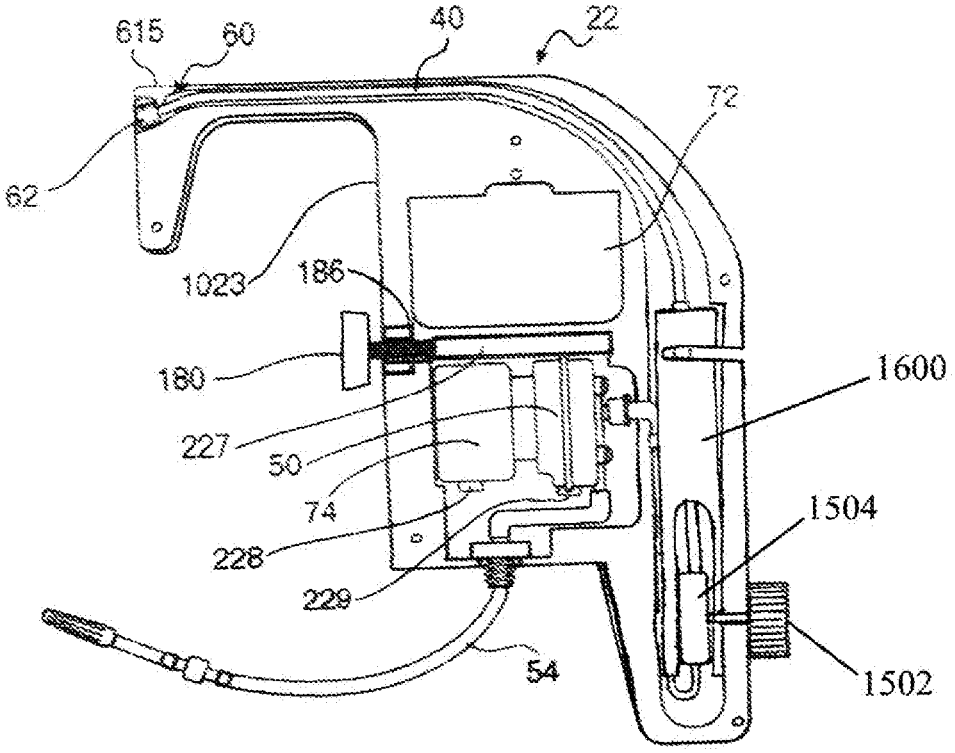
FIG. 3B is an interior side perspective view of the first half section of the housing in FIG. 3A showing a longitudinal cylindrical member mounted superjacent the floor of the recessed channel of the first half section.
Figure 3C:
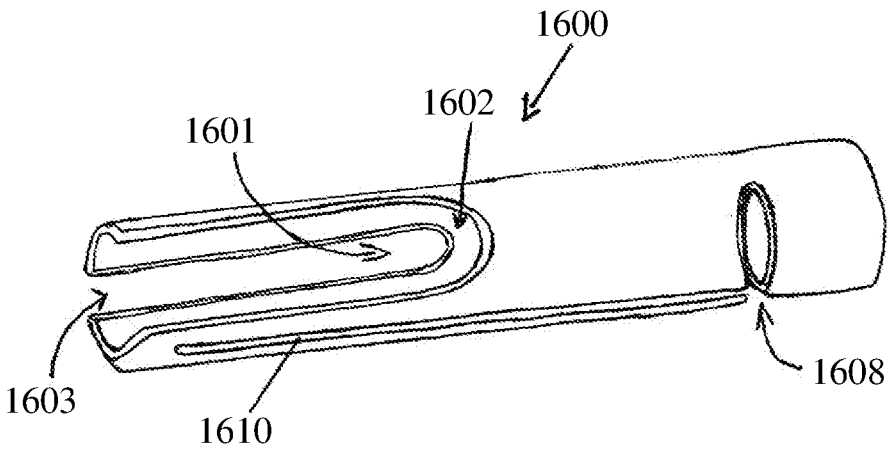
FIG. 3C is a side perspective view of the longitudinal cylindrical member illustrated in FIG. 3B, in accordance to one embodiment of the present invention.
Figure 3D:
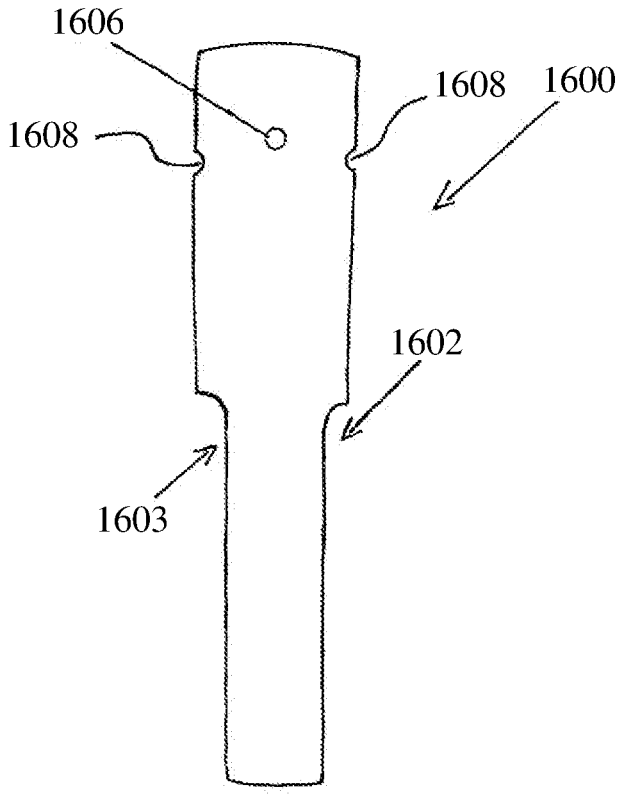
FIG. 3D is a rear side elevational view of the longitudinal cylindrical member of FIG. 3C.

Referring now more particularly to FIGS. 1A, 1B, 3A, 3B, and 3C, a longitudinal cylindrical member 1600 is disclosed, wherein longitudinal cylindrical member 1600 is mounted superjacent the floor 601 of the recessed channel 600 within the guide chamber 627 of housing 20. As depicted in FIG. 3B, the cylindrical member 1600 extends between the proximal and distal ends 602 and 604 of the recessed channel 600 of the first half section 22. The cylindrical member 1600 has an open interior 1601 for slidably receiving the flanged fitting 1504 of the discharge control and adjustment mechanism 500*a* and a section of the discharge conduit 40 in an intimate, close-fitting relationship. The cylindrical member 1600 includes a horizontal slit 1608 provided in the circumferential sidewall along the front side thereof, and a vertically-oriented slot 1610 defined through the circumferential sidewall of cylindrical member 1600, along the front side thereof. The vertically-oriented slot 1610 is in open, fluid communication with the horizontal slit 1608. As the knob 1502 is slidably moved between positions P1 and P2, the pin 1505 of the discharge control and adjustment mechanism 500*a* slidably reciprocates corresponsively along the vertically-oriented slot 1610. The cylindrical member 1600 further comprises opposed, generally oval-shaped openings 1602 and 1603 oriented distal to the horizontal slit 1608. An aperture 1606 is defined through the circumferential sidewall of cylindrical member 1600, along the rear side thereof. The aperture 1606 provides a foramen through which the head 643 of the switch arm 642 protrudes. The control switch 640 alternately closes and opens in response to pressure applied thereagainst and released therefrom by the switch arm 642. For example, in order to activate the motor 74 to drive the pump 50, the knob 1502 is slidably moved upwardly within the open interior 1601 of longitudinal cylindrical member 1600 to position P2. As the knob 1502 is slidably moved upwardly to position P2, the nozzle assembly 60 and discharge conduit 40 extend from a retracted position to the liquid discharge position DP in a concurrent, correlated manner. When the knob 1502 is positioned at position P2, the flanged fitting 1504 contacts the head 643 of the switch arm 642 causing switch arm 642 to contact the control switch 640, thereby actuating the control switch 640 to activate the motor 74. In order to deactivate the motor 74 and thus stop the pump 50, the knob 1502 is slidably moved downward towards position P1, thereby removing contact by flanged fitting 1504 with the switch arm 642 and opening (or arresting) the control switch 640, and thus deactivating the motor 74.

Likewise, as the knob 1502 is slidably moved downward to position P1, the nozzle assembly 60 and discharge conduit 40 retract in a concurrent, correlated manner until the knob 1502 is positioned at position P1 at which the nozzle assembly 60 is received in the nozzle retaining cavity 630 and discharge conduit 40 is received in guide channel 610.

Referring now more particularly to FIG. 1B, the hygiene device 10 is adapted and configured to enable the spray nozzle 62 of the nozzle assembly 60 to oscillate and enable liquid 7 to be discharged therefrom about a cubic plane curve or "curved plane" PC, thereby allowing liquid 7 to be discharged from the discharge outlet 66 of the spray nozzle 62 and applied to a greater surface area of the posterior portions and genitals of a user's body. When the knob 1502 is moved to position P2, the knob 1502 is toggled to the right and to the left (and vice-versa) in a continuous, sequential manner along the horizontally-oriented toggle slot 1510.

Toggling the knob 1502 to the right causes the discharge conduit 40 to move in a direction to the left, as indicated by direction arrow B, and causes the spray nozzle 62 to swivel along curved plane portion A (CPA) of cubic plane curve PC. Toggling knob 1502 to the left causes the discharge conduit 40 to move in a direction to the right, as indicated by direction arrow A, and causes the spray nozzle 62 to swivel along curved plane portion B (CPB) of cubic plane curve PC.

Referring now to FIG. 15, in accordance to another exemplary embodiment, the motor 74 is alternatively activated via a control switch 640*a* in the form of a depressible button 640*b* disposed about housing 20. In further accordance to this particular embodiment, the control switch 640*a* and the motor 74 are electrically interconnected via wiring. The depressible switch 640*a* alternately opens and closes in response to pressure applied corresponsively against the depressible button 640*b*. For example, the depressible button 640*b* may be depressed a first time to activate motor 74, and depressed a second time to deactivate motor 74.

The depressible button 640*a* is shown in FIG. 15 as being suitably mounted to the continuous sidewall 28 of second half section 26 of housing 20. While the depressible button 640*a* may be positioned at other locations about the housing 20, the depressible button 640*a* is preferably located at a position being proximal to and easily accessible by user during operation of the hygiene device 10.

Figure 15A:
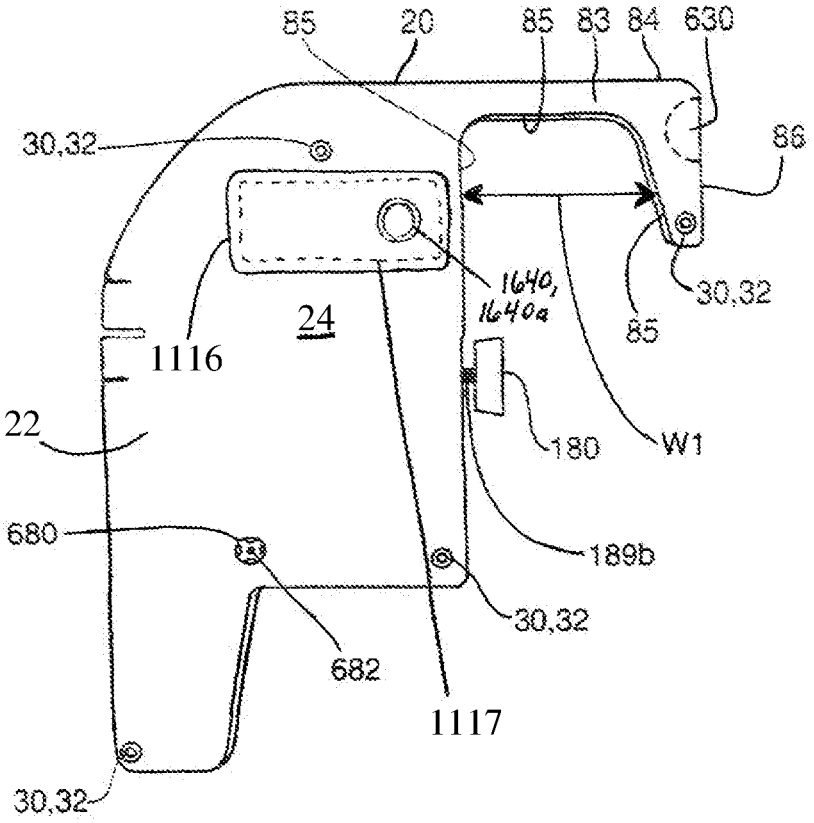
FIG. 15A is a right side elevational view of a personal hygiene device, according to another embodiment of the present invention.

In reference to FIG. 15A, in accordance to another exemplary embodiment, the motor 74 is activated via a control switch 1640 in the form of a depressible button 1640*a* disposed about the housing 20. The housing 20 may comprise an enlarged opening 1117 defined through the first half section 22 or the second half section 26. The enlarged opening 1117 is shown in FIG. 15A as being defined through the first half section 22. A removable panel 1116 or door is detachably affixed to the half section 22 (or half section 26)

so as to cover completely enlarged opening 1117. The panel 1116 may be detachably affixed to half section 22 (or half section 26) via a snap-fit arrangement, a mechanical interference-type fit, a hook-and-loop fastening system, a suitable fastener, e.g., one or more screws, or other suitable attaching means. The panel 1116 may also be more securely affixed to the half section 22 such as via an adhesive or epoxy. The depressible button 1640*a* is suitably mounted to the removable panel 1116.

In further accordance to the embodiment illustrated in FIG. 15A, the control switch 1640 and the motor 74 are electrically interconnected via wiring. The depressible switch 1640 alternately closes and opens in response to pressure applied against and released from the depressible button 1640*a*, respectively. For example, in order to activate the motor 74 to drive the pump 50, the depressible button 1640*a* is depressed and held in the depressed position. In order to deactivate the motor 74 and thus stop the pump 50, the depressible button 1640*a* is released.

It is envisioned that in accordance with another embodiment, in order to activate the electric motor 74 to drive the pump 50, the hygiene device 10 may comprise the combination of a control switch 1640 and a knob 502, 1502, thereby providing the user with the option to select either means for activating the pump 50 to discharge liquid from the spray nozzle 62.

Referring now to FIGS. 3, 4, 6, 6A, 8, 9, 12, and 20-23, as previously described, the pump 50 draws water 7 or liquid from the reservoir 110 via the flexible conduit 54. The reservoir 110 is defined as a replaceable, refillable reservoir 110, the reservoir 110 may comprise a conventional beverage container 112, such as a plastic water bottle 113. The container adapter 160 is provided for sealingly engaging the neck 114 of the beverage container 112. The neck 114 of the container 112 has an inside diameter 118 and an outside diameter 119. Typically, the neck 114 further includes a plurality of threads 114*a* for threadedly engaging complementary threads of a bottle cap. The container adapter 160 has a body 162 comprising an annular wall 162*a*, the body 162 includes a top portion 163, a bottom portion 164, and an axial through passage 165 through which the flexible conduit 54 extends and is connected in a frictionally-secured, sealing relationship. The top portion 163 includes an upper surface 163*a*, a lower surface 163*b*, and an upwardly projecting sidewall 163*c* integrally joining the upper surface 163*a* and lower surface 163*b*, the sidewall 163*c* forming a circular perimeter around the top portion 163.

The lower surface 163*b* of the top portion 163 of the container adapter 160 is suitably affixed to the upper surface 234 of the mouth of opening 232.

Figure 22:
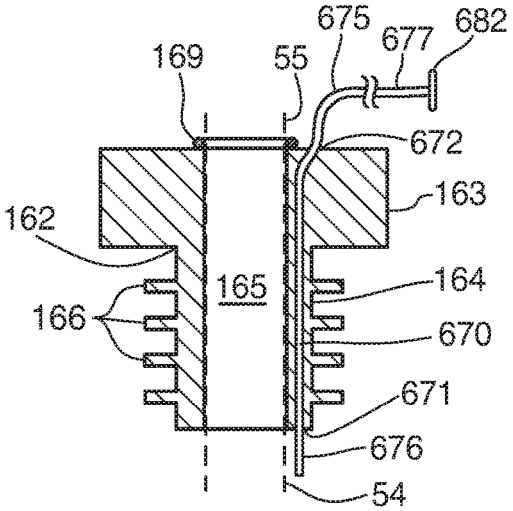
FIG. 22 is a cross-sectional view of a container adapter, in accordance to one embodiment of the present invention.

The axial through passage 165 is defined centrally through the body 162, as best shown in FIG. 22. In addition, a sealant material, gasket 169 or annular collar may be provided for securably connecting the axial through passage 165 with the flexible conduit 54 in a sealed relationship, thereby preventing leakage of water 7 or liquid outside of adapter 160.

The body 162 of container adapter 160 may comprise an enlarged top portion 163 from which a narrow bottom portion 164 extends integrally downward, centrally therefrom.

A plurality of thin, resilient annular flanges 166 molded integral to the bottom portion 164 surround the through passage 165. The annular flanges 166 have an outside diameter 167 that is greater than the inside diameter 118 of the neck 114 of container 112. When the bottom portion 164 is forced into the neck 114 of container 112, the flanges 166 are compressed against the inside circumferential surface 115 of neck 114, securing the adapter 160 in the container 112, and sealing the junction therebetween.

A bore 670 extends vertically through the annular wall 162*a* of body 162. An elongated, flexible tube 675 extends through the bore 670 and is securely retained therein in a tight-fit arrangement. The tube 675 includes a lower end 676 extending through the bore inlet 671 and an upper end 677 extending through the bore outlet 672 and coupled to an air check valve 682 to which the tube 675 is in fluid communication.

The air check valve 682 is disposed within the airflow opening 680 (see FIG. 8) of housing 20 and is configured so as to permit air to flow from the container 112 to the airflow opening 680, but prevents air and fluid from flowing out of the airflow opening 680. The air check valve 682 may be any form of check valve capable of allowing air or fluid to flow in one direction while preventing air or fluid flow in the opposite direction.

Figure 20:
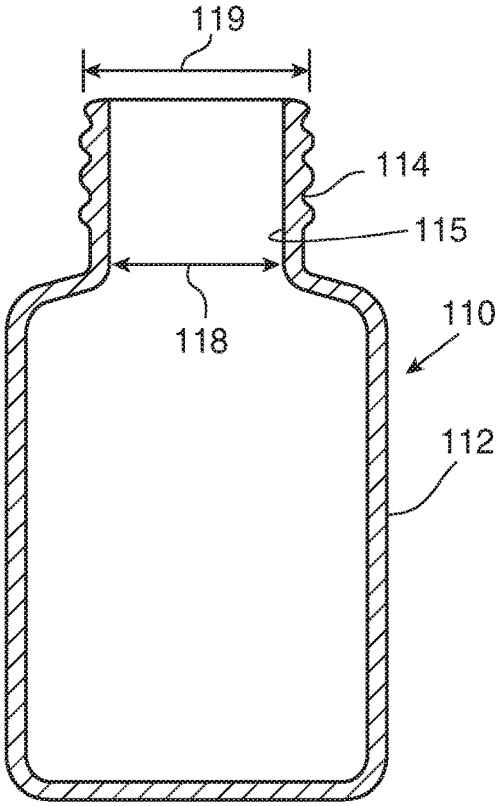
FIG. 20 is a cross-sectional view of a reservoir, in accordance to one embodiment of the present invention.
Figure 23:
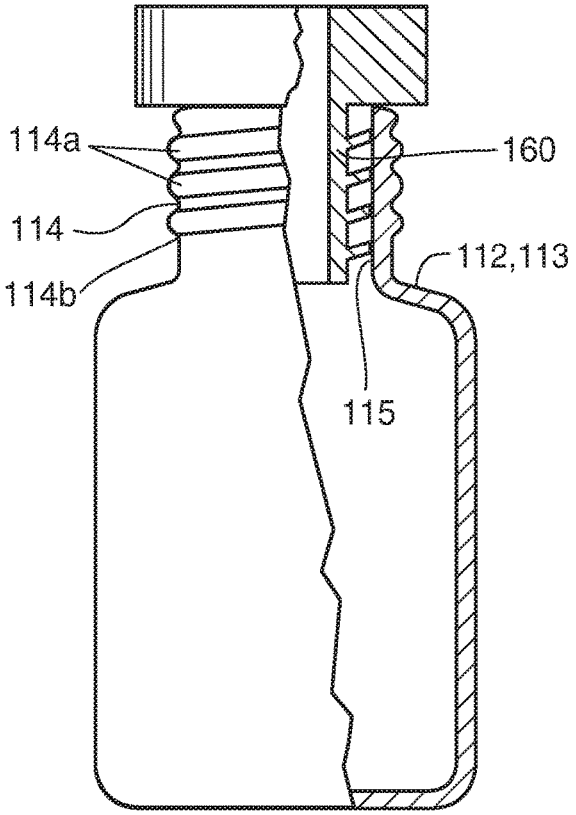
FIG. 23 is a partial cross-sectional view of a beverage container showing the container adapter sealingly engaging the neck thereof in a secured relationship, in accordance to one embodiment of the present invention.
Figure 21:
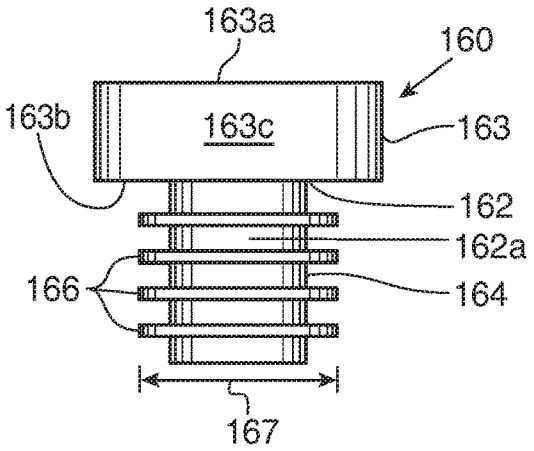
FIG. 21 is a side elevational view of a container adapter, in accordance to one embodiment of the present invention.
Figure 23A:
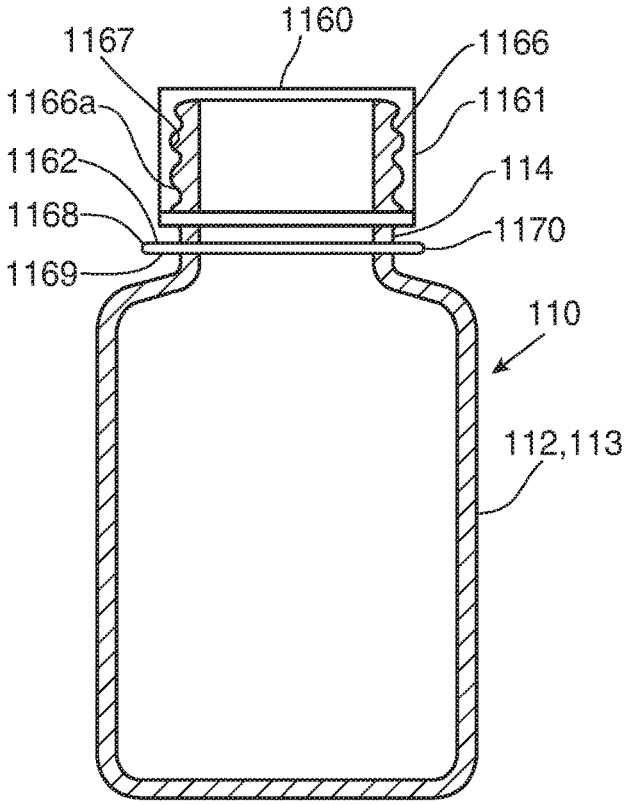
FIG. 23A is a cross-sectional view of another reservoir, in accordance to one embodiment of the present invention.
Figure 23B:
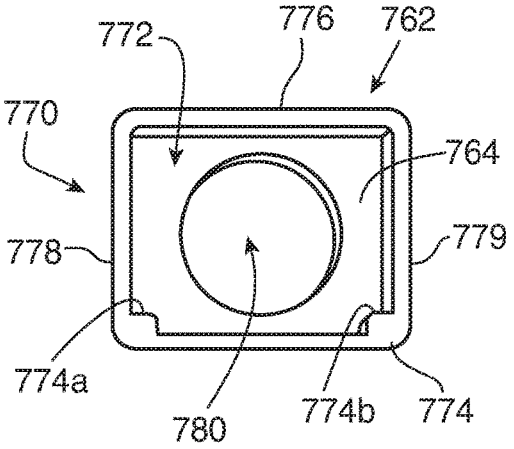
FIG. 23B is a top perspective view of a platform of a reservoir coupling mechanism, in accordance to one embodiment of the present invention.
Figure 23C:
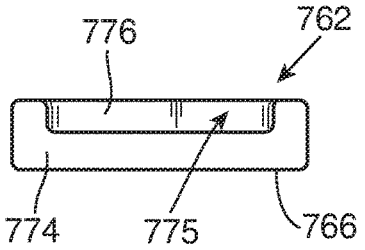
FIG. 23C is a front end elevational view of the platform of FIG. 23B.
Figure 23D:
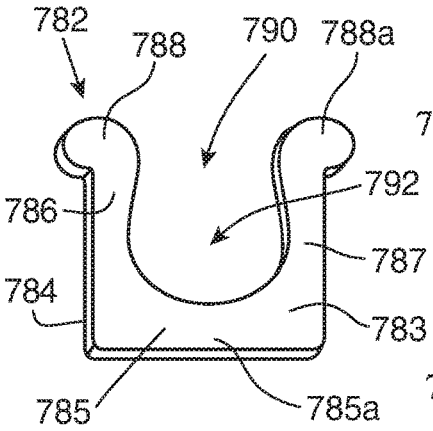
FIG. 23D is a top perspective view of a flexible, returnably-resilient pin of the reservoir coupling mechanism, in accordance to one embodiment of the present invention.

Referring now to FIGS. 15, 20, and 23, and more specifically to FIG. 23A, according to another embodiment, the reservoir 110 is illustrated as a plastic water bottle 113, and the reservoir closure cap 1160 is illustrated as a bottle cap 1161. The neck 114 of bottle 113 includes a plurality of threads 1166, and the bottle cap 1161 includes a plurality of complementary threads 1167, so as to allow the bottle cap 1161 to threadedly engage the neck 114. The annular collar 1162 is positioned along the neck 114 of the bottle 113, below a lowermost thread 1166*a* of the plurality of threads 1166 of neck 114. The annular collar 1162 may protrude radially from the neck 114 a greater diametrical measure than the bottle cap 1161, when cap 1161 is threadedly engaged with neck 114. The annular collar 1162 includes a continuous upper surface 1168 integrally joined to a continuous lower surface 1169 by a continuous side surface 1170. The opening 232 is shown and described as being circular herein, but other geometric shapes to define opening 232 are envisioned and within the scope and spirit of this application.

In reference now more particularly to FIGS. 6B, 15, 20, and 23A-23F, a reservoir coupling mechanism 760 is provided for detachably securing a reservoir 110, and more particularly, a beverage container 112, such as a plastic water bottle 113, to the hygiene device 10. The reservoir coupling mechanism 760 comprises a platform 762 molded integral or suitably mounted to the outer surface of a lower section of the housing 20, intermediate to the dorsal side D and ventral side V thereof. More specifically, the platform 762 is molded integral to or suitably mounted transverse to the continuous sidewall 24 along the second horizontal wall 222 of half section 22 and to the continuous sidewall 28 along partially-extending horizontal wall 428 of half section 26.

The platform 762 defines an upper surface 764 and a lower surface 766. The platform 762 further comprises a plurality of side walls 770 extending upward integrally about a perimeter of the platform 762 forming a recessed enclosure 772 on the upper surface 764 of platform 762. The plurality of sidewalls 770 comprises a front side wall 774 opposing a rear side wall 776, and a first end side wall 778 opposing a second end side wall 779. The front side wall 774 includes an elongated mortise 775 extending a substantial length theredown integrally forming opposed, raised abutment columns 774*a* and 774*b* (the function of which to be described later in greater detail).

The platform 762 further comprises a neck receiving void 780 defined perpendicularly therethrough, about a center thereof, wherein the neck receiving void 780 includes a diameter measuring larger than a diameter of an annular collar 1162 of a beverage container 112. The diameter of the neck receiving void 780 is also larger than a diameter of external threads 114*a*, 1166 of the neck 114 of a beverage container 112 (for beverage containers 112 which are absent of an annular collar 1162).

The reservoir coupling mechanism 760 further comprises a flexible, returnably-resilient pin 782 for flexible attachment to a reservoir 110. The pin 782 comprises a generally U-shaped, planar configuration having an upper surface 783 and a lower surface 784. The pin 782 defines a horizontal member 785 bifurcating integrally into a pair of curvilinear arms 786, 787, the pair of curvilinear arms 786, 787 extending in a spaced relationship. The curvilinear arms 786, 787 terminate in divergently projecting bulbous ears 788, 788*a*, respectively.

Each the first curvilinear arm 786 second curvilinear arm 787 comprises an anterior section 786*a*, 787*a* and a posterior section 786*b*, 787*b*, respectively. The first curvilinear arm 786 extends outwardly from a convergence 789 of horizontal member 785 and curves inward and tapers from a greater transverse width at the anterior section 786*a* thereof, and extends therefrom and slightly narrows to a smaller transverse width at the posterior section 786*b* thereof. The second curvilinear arm 787 extends outwardly from the convergence 789 of horizontal member 785 and curves inward and tapers from a greater transverse width at the anterior section 787*a* thereof, and extends therefrom and slightly widens to a smaller transverse width at the posterior section 787*b* thereof. The spaced distance SD1 between the facially-adjacent arms 786 and 787 is substantially greater than the spaced distance SD2 between the facially-adjacent arms 786 and 787. In addition, in accordance to this particular embodiment, the spaced distance SD2 measures less than the outside diameter 119 of the neck 114 of a selected beverage container 112.

The open space provided between the pair of arms 786, 787 forms a neck retaining void 792 for receiving a neck 114 of a beverage container 112. An entry portal 790 is provided between opposed curved edges 786*c*, 787*c* of the curvilinear arms 786, 787, respectively, wherein the entry portal 790 providing direct and open passage to the neck retaining void 792.

The pin 782 is positioned in the recessed enclosure 772 of platform 762 and slidably reciprocates along the upper surface 764 thereof. More specifically, the lower surface 784 of pin 782 slidably engages the upper surface 764 of platform 762 in a reciprocating manner. The pin 782 slidably reciprocates along the upper surface 764 of platform 762 linearly between the front side wall 774 and rear side wall 776 of platform 762. The horizontal member 785 provides a handle 785*a* by which the operator grasps the pin 782. The mortise 775 of platform 762 provides a recessed space through which the handle 785*a* extends outwardly therefrom, thereby allowing the pin 782 to be manipulated or otherwise grasped by the operator (as best illustrated in FIG. 15).

Figure 23F:
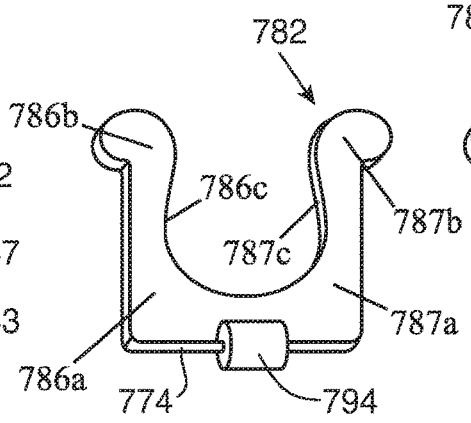
FIG. 23F is a top perspective view of a flexible, returnably-resilient pin of the reservoir coupling mechanism, in accordance to another embodiment of the present invention.
Figure 23E:
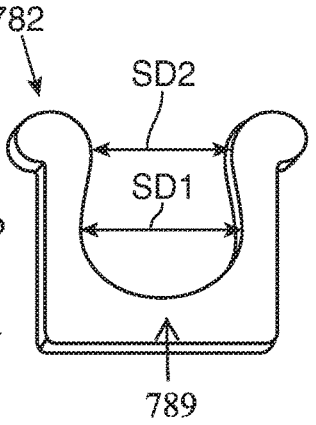
FIG. 23E is a top perspective view of a flexible, returnably-resilient pin of the reservoir coupling mechanism illustrating a tapering of the arms thereof, in accordance to one embodiment of the present invention.

In reference to FIG. 23F, an alternate embodiment of the present invention is disclosed for enhancing the grip of the handle 785*a*, wherein the handle 785*a* includes an elongated, cylindrical boss 794 disposed about the center of the front side wall 774.

In order to prevent the pin 782 from being fully extracted from the platform 762, the ears 788, 788*a* of pin 782 engage the opposed, raised abutment columns 774*a*, 774*b*, respectively.

In order to detachably secure a beverage container 112 to the hygiene device 10 via the reservoir coupling mechanism 760, the user inserts the inlet 55*a* end of the flexible conduit 54 axially through the neck 114 and into the body of a selectively-desired, fluid-containing container 112. User then grasps and slidably pulls the handle 785*a* of the pin 782 rearwardly from the platform 762.

Next, the user longitudinally aligns and inserts the neck 114 of the container 112 through the opening 232 of the housing 20 and pushes the handle 785*a* forwardly, thereby engaging the pair of curvilinear arms 786, 787 against the external circumferential surface of the neck 114, below the annular collar 1162 (or below an external thread 1166 of neck 114 for beverage containers 112 absent of an annular collar 1162). User continues to push the handle 785 using a forward force causing the curvilinear arms 786, 787 to flex divergently and permitting the neck 114 of the beverage container 112 to move perpendicularly through the entry portal 790 and into the neck retaining void 792, wherein the curvilinear arms 786, 787 apply an inwardly-directed or compressional biasing force against the external circumferential surface of the neck 114, and the upper surface 783 of each the pair of curvilinear arms 786, 787 engages the continuous lower surface 1169 of the annular collar 1162 of beverage container 112 (or external thread interface 114*b* for beverage containers 112 absent of an annular collar 1162), securely retaining the beverage container 112 to the housing 20.

Figure 24:
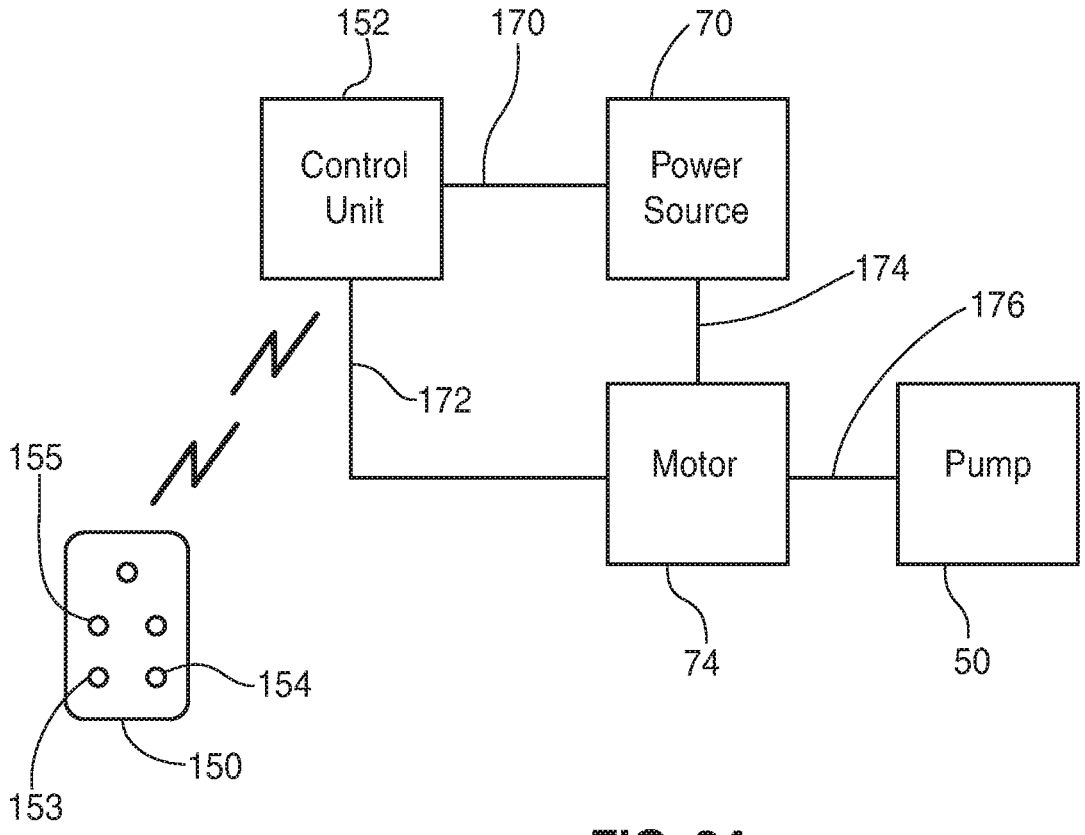
FIG. 24 illustrates by schematic view portions of an exemplary implementation of a personal hygiene device, wherein the operation thereof controlled via a portable remote control device, in accordance to one embodiment of the present invention.

Referring now more particularly to FIG. 24, in accordance to one embodiment, a portable remote control device 150 for remote control operation of the hygiene device 10 is disclosed. The operation of the motor 74 may be controlled by a portable wireless transmitter 150 through wireless communications of wireless signals between wireless transmitter 150 and a controller unit 152. The controller unit 152 is in electrical communication with power source 70 via pathway 170. The controller unit 152 is in electrical communication with the motor 74 via pathway 172. The power source 70 is electrically connected to motor 74 via pathway 174, and wherein the pump is electrically connected to motor 74 via pathway 176.

The controller unit 152 is adapted to transmit analog control signals, digital control signals, or combinations thereof along pathway 172 to control the operation of the motor 74. The controller unit 152 is adapted to receive wireless signals from wireless transmitter 150 with the wireless signals adapted to direct controller unit 152 to activate or deactivate motor 74, which thereby in turn, respectively starts or stops the pump 50.

For example, the user may push button 153 on remote transmitter 150 thereby transmitting a wireless signal from remote transmitter 150 to controller unit 152, the wireless signal causing controller unit 152 to activate motor 74 thereby starting the pump 50 from which water 7 is transferred to the nozzle assembly 60 and discharged therefrom. By way of another example, the user may push button 154 on remote transmitter 150 thereby transmitting a wireless signal from remote transmitter 150 to controller unit 152, the wireless signal causing controller unit 152 to deactivate motor 74 thereby stopping the pump 50.

In various implementations, the user may be able to control the energy or velocity of the stream of water 7 discharged from the spray nozzle 62. The user, for example, may push button 155 on remote transmitter 150 thereby transmitting a wireless signal from remote transmitter 150 to controller unit 152, the wireless signal causing controller unit 152 to activate motor to operate at a lower discharge pressure, thereby actuating pump 70 to generate a more energetic, higher velocity volume stream or spray of liquid or water 7 being discharged from the spray nozzle 62.

Accordingly, the operation of the motor 74 and pump 50 may be controlled by wireless transmitter 150 through wireless communications of wireless signals between wireless transmitter 150 and controller unit 152.

Finally, in reference to FIG. 25, according to another embodiment, the pump 50 draws water 7 from a conventional water line WL using the flexible conduit 54*a* and transfers the water 7 into the flexible, retractable conduit 40 through which the water 7 is delivered to the nozzle-assembly 60 for discharge therefrom. The flexible conduit 54*a* comprises a first length 654 and a second length 754, the first and second lengths 654 and 754 are connected by a water flow valve 660 and are in fluid communication therewith. The water flow valve 660 includes an inlet port 662, an outlet port 664, and a control lever 667 to permit the flow of water from the second length 754 to the first length 654. The control lever 667 is of a conventional, manually-operated, turnable valve design for controlling the passage of fluid through a tubular element, such as a conduit.

The first length 654 of flexible conduit 54*a* having an inlet 655*a* and an outlet 655, the outlet 655 sealably connected to the end of first elbow fitting 56 in an airtight sealed manner, and the inlet 655*a* sealably connected to the outlet port 664 of valve 660, and the second length 754 of flexible conduit 54*a* having an inlet 755*a* and an outlet 755, the outlet 755 sealably connected to the inlet port 662 of valve 660. The inlet 755*a* is sealably connected to a spigot S of the conventional water line WL via a compressible spigot adapter 700. The spigot adapter 700 includes an outlet 702 and an inlet 704, the outlet 702 sealably connected to the inlet 755*a* of the second length 754, and the inlet 704 removably connected in an airtight sealed fashion to the spigot S. The spigot adapter 700 is firmly secured to the spigot S via mechanical interference. To provide a supply of water 7 to the hygiene device 10, the lever of spigot S is turned, pivoted, or manipulated in the conventional manner for permitting water 7 to flow from the conventional water line WL and through the spigot S. Next, the control lever 667 is manipulated (e.g., turned in one direction) to permit water 7 to transfer from the second length 754 to the first length 654 from which the water 7 is drawn by the pump 50 which transfers the water 7 into the flexible, retractable conduit 40 through which the water 7 is delivered to the nozzle assembly 60 from which the water 7 is discharged therefrom. To stop discharge of water 7 from the nozzle assembly 60, the control lever 667 is manipulated in the opposite direction.

It is envisioned that the various embodiments, as separately disclosed, are interchangeable in various aspects, so that elements of one embodiment may be incorporated into one or more of the other embodiments, and that specific positioning of individual elements may necessitate other arrangements not specifically disclosed to accommodate performance requirements or spatial considerations.

It is to be understood that the embodiments and claims are not limited in its application to the details of construction and arrangement of the components set forth in the description and illustrated in the drawings. Rather, the description and the drawings provide examples of the embodiments envisioned, but the claims are limited to the specific embodiments. The embodiments and claims disclosed herein are further capable of other embodiments and of being practiced and carried out in various ways. Also, it is to be understood that the phraseology and terminology employed herein are for the purposes of description and should not be regarded as limiting the claims.

Accordingly, those skilled in the art will appreciate that the conception upon which the application and claims are based may be readily utilized as a basis for the design of other structures, methods, and systems for carrying out the several purposes of the embodiments and claims presented in this application. It is important, therefore, that the claims be regarded as including such equivalent constructions.

Furthermore, the purpose of the foregoing Abstract is to enable the U.S. Patent and Trademark Office and the public generally, and especially including the practitioners in the art who are not familiar with patent and legal terms or phraseology, to determine quickly from a cursory inspection the nature and essence of the technical disclosure of the application. The Abstract is neither intended to define the claims of the application, nor is it intended to be limiting to the scope of the claims in any way. It is intended that the application is defined by the claims appended hereto.

What is claimed is:

1. A hygiene device comprising:

a housing, the housing being detachably secured to a container, the housing comprises an integrally molded first interior chamber and an integrally molded second interior chamber;

a power source, the power source is enclosed within the first interior chamber;

a motor;

a control switch;

a pump, the pump and the motor are enclosed within the second interior chamber, the pump is driven by the motor, the motor is powered via the power source, activation of the motor is controlled by the control switch;

a nozzle assembly;

a flexible discharge conduit, the flexible discharge conduit interconnects the nozzle assembly with the pump, the nozzle assembly and the flexible discharge conduit being slidably extendable from and fully retractable into the housing;

a flexible intake conduit, the flexible intake conduit interconnects the pump and a reservoir, the pump draws liquid from the reservoir via the flexible intake conduit, and wherein the pump transfers the drawn liquid into the flexible discharge conduit through which liquid is delivered to the nozzle assembly and discharged therefrom as a spray or stream; and a discharge control and adjustment mechanism, the discharge control and adjustment mechanism comprising a knob, the knob comprising a flanged fitting and a pin, wherein the knob is coupled to the flanged fitting via the pin, the knob operating to control the slidable extension and retraction of the nozzle assembly and the flexible discharge conduit about selectively-desired, retracted and extended setting positions, and wherein the knob operating to engage and disengage the control switch, thereby activating and deactivating the motor, respectively, and wherein the nozzle assembly and the flexible discharge conduit oscillate about a cubic plane curve in the extended setting position by toggling the knob.

2. The device of claim 1, wherein the housing further comprises:

a vertical slot disposed in the housing, the vertical slot includes an upper terminus and a lower terminus, the upper terminus extends into a horizontally-oriented toggle slot, the toggle slot is in open, fluid communication with the vertical slot, wherein the pin of the knob translates along the vertical slot during retraction and extension of the nozzle assembly and the flexible discharge conduit, and the pin of the knob reciprocates along the toggle slot causing the nozzle assembly and the flexible discharge conduit to oscillate about a cubic plane curve in the extended setting position; and an integrally molded mounting bracket, the mounting bracket fits over and frictionally engages a rim of a container, the housing being detachably secured to the container.

3. The device of claim 2, wherein the container is a toilet bowl.

4. The device of claim 1, wherein the liquid is water.

5. The device of claim 1, wherein the liquid is selected from the group consisting of hygienic solutions, and solutions each comprising one or more medicinal agents.

6. The device of claim 1, wherein the reservoir is defined as a replaceable, refillable reservoir.

7. The device of claim 6, wherein the replaceable, refillable reservoir is a beverage container.

8. The device of claim 1, wherein the nozzle assembly and flexible discharge conduit are fully retractable to a position defined as where the nozzle assembly and flexible discharge conduit are wholly or completely received inside the housing.

9. The device of claim 1, further comprising a reservoir coupling mechanism for detachably securing the reservoir to the housing.

10. The device of claim 9, wherein the reservoir coupling mechanism comprises:

a platform molded integral or suitably mounted to an outer surface of a lower section of the housing, intermediate to the dorsal side and ventral side V of the housing; and a flexible, returnably-resilient pin, the flexible, returnably-resilient pin slidably reciprocates along an upper surface of the platform, the flexible, returnably-resilient pin comprises:

a horizontal member bifurcating integrally into a pair of curvilinear arms, the pair of curvilinear arms extending in a spaced relationship, and the pair of curvilinear arms terminate in divergently projecting bulbous ears, respectively;

a neck retaining void provided between the pair of curvilinear arms, the pair of curvilinear arms comprises opposed curved edges, respectively; and an entry portal oriented between the opposed curved edges of the pair of curvilinear arms, wherein the entry portal provides direct and open passage to the neck retaining void, and wherein the pair of curvilinear arms flexes divergently and permits a neck of the reservoir to move perpendicularly through the entry portal and into the neck retaining void, whereupon the pair of curvilinear arms applies an inwardly-directed or compressional biasing force against an external circumferential surface of the neck, thereby securely attaching the reservoir to the housing.

11. The device of claim 1, wherein the housing further comprises an adjustable brace, the brace enhancing secured attachment of the hygiene device to a toilet rim, the brace is movable between axially retracted and extended positions.

12. A portable hygiene device comprising:

a housing, the housing comprises:

a two-piece unit, the unit comprising a first half section and a second half section, the first half section and the second half section are intimately connected securely via a plurality of fasteners, thereby forming the housing, and wherein the housing further comprises:

an integrally molded first interior chamber;

an integrally molded second interior chamber;

a power source, the power source is enclosed within the first interior chamber;

a motor;

a control switch;

a pump, the pump and motor are enclosed within the second interior chamber, the pump is driven by the motor, the motor is powered via the power source, activation of the motor is controlled by the control switch;

a nozzle assembly;

a flexible discharge conduit, the flexible discharge conduit interconnects the nozzle assembly with the pump;

a flexible intake conduit, the flexible intake conduit interconnects the pump and a reservoir, the pump draws liquid from the reservoir via the flexible intake conduit, and wherein the pump transfers the drawn liquid into the flexible discharge conduit through which liquid is delivered to the nozzle assembly and discharged therefrom as a spray or stream;

a discharge control and adjustment mechanism, the discharge control and adjustment mechanism comprising a knob, the knob comprising a flanged fitting and a pin, wherein the knob is coupled to the flanged fitting via the pin, the knob operating to control slidable extension and retraction of the nozzle assembly and the flexible discharge conduit about selectively-desired, retracted and extended setting positions, and wherein the nozzle assembly and the flexible discharge conduit oscillate about a cubic plane curve in the extended setting position by toggling the knob; and a portable remote control device for remotely controlling the operation of the hygiene device.

13. The portable hygiene device of claim 12, wherein the remote control device comprises:

a portable wireless transmitter; and a controller unit in wireless communication with the wireless transmitter, the controller unit is in electrical communication with the power source and the motor; the controller unit is adapted to receive wireless signals transmitted from the wireless transmitter with the wireless signals adapted to direct the controller unit to control the operation of the motor.

14. The portable hygiene device of claim 13, wherein the controller unit is adapted to receive wireless signal(s) transmitted from wireless transmitter with the wireless signal(s) adapted to direct the controller unit to activate or deactivate motor, thereby starting or stopping the pump, respectively, and in turn, respectively causing liquid to discharge as a spray or stream from the nozzle assembly or stopping liquid discharge from the nozzle assembly.

15. The portable hygiene device of claim 13, wherein the wireless transmitter transmits wireless signal(s) received by the controller unit, the wireless signal(s) causing the controller unit to activate the motor to operate at a lower discharge pressure, thereby actuating the pump to generate a more energetic, higher velocity volume stream or spray of liquid being discharged from the nozzle assembly.

16. The portable hygiene device of claim 12, further comprising a container adapter suitably disposed within a lower section of the housing, the container adapter for removably attaching the reservoir to the housing.

17. A personal hygiene device comprising:

a housing being detachably secured to a container, the housing comprises:

at least one integrally molded interior chamber;

a power source, the power source is enclosed within the at least one interior chamber;

an electric motor;

a control switch;

a pump, the pump and the motor are enclosed within the at least one interior chamber, the pump is driven by the motor, the motor is powered via the power source, activation of the motor is controlled by the control switch;

a nozzle assembly;

a flexible discharge conduit, the flexible discharge conduit interconnects the nozzle assembly with the pump;

a spigot adapter;

a water flow valve;

a discharge control and adjustment mechanism, the discharge control and adjustment mechanism comprising a knob, the knob comprising a flanged fitting and a pin, wherein the knob is coupled to the flanged fitting via the pin, the knob operating to control the slidable extension and retraction of the nozzle assembly and the flexible discharge conduit about selectively-desired, retracted and extended setting positions, and wherein the knob operating to engage and disengage the control switch, thereby activating and deactivating the motor, respectively, and wherein the nozzle assembly and the flexible discharge conduit oscillate about a cubic plane curve in the extended setting position by toggling the knob; and a flexible intake conduit, the flexible intake conduit interconnects the pump and a water line of a residence or a commercial entity, the water flow valve is connected to the flexible intake conduit and in fluid communication therewith, the spigot adapter detachably connects the pump, via the flexible intake conduit, to a spigot of the water line, the spigot adapter allows fluid communication between the water line, the flexible intake conduit, and the pump, and wherein the pump draws liquid from the water line via the flexible intake conduit, the water flow valve controlling a flow of water between the water flow valve and the pump, where the water flow valve is in an open condition, the pump transfers the drawn water into the flexible discharge conduit through which the water is delivered to the nozzle assembly and discharged therefrom as a spray or stream.

* * * * *